US006640605B2

(12) United States Patent
Gitlin et al.

(10) Patent No.: US 6,640,605 B2
(45) Date of Patent: Nov. 4, 2003

(54) METHOD OF BENDING SHEET METAL TO FORM THREE-DIMENSIONAL STRUCTURES

(75) Inventors: Bruce Gitlin, New York, NY (US); Alexander Kveton, Staten Island, NY (US); Haresh Lalvani, New York, NY (US)

(73) Assignee: Milgo Industrial, Inc., Brooklyn, NY (US)

( * ) Notice: Subject to any disclaimer, the term of this patent is extended or adjusted under 35 U.S.C. 154(b) by 0 days.

(21) Appl. No.: 10/116,708

(22) Filed: Apr. 4, 2002

(65) Prior Publication Data

US 2002/0184936 A1 Dec. 12, 2002

Related U.S. Application Data

(63) Continuation-in-part of application No. 09/492,994, filed on Jan. 27, 2000, now abandoned.
(60) Provisional application No. 60/117,566, filed on Jan. 27, 1999.

(51) Int. Cl.[7] ..... B21D 5/00
(52) U.S. Cl. ..... 72/379.2
(58) Field of Search ..... 72/335, 379.2

(56) References Cited

U.S. PATENT DOCUMENTS

| | | | | |
|---|---|---|---|---|
| 4,215,194 | A | 7/1980 | Shepherd | |
| 4,559,259 | A | 12/1985 | Cetrelli | |
| 4,628,661 | A | 12/1986 | St. Louis | |
| 4,837,066 | A | 6/1989 | Quinn et al. | |
| 5,239,741 | A | 8/1993 | Shamos | |
| 5,524,396 | A | 6/1996 | Lalvani | |
| 5,701,780 | A | 12/1997 | Ver Meer | |
| 6,412,325 | B1 * | 7/2002 | Croswell | 72/379.2 |
| 6,481,259 | B1 * | 11/2002 | Durney | 72/379.2 |

FOREIGN PATENT DOCUMENTS

| | | |
|---|---|---|
| JP | 55-22468 | 2/1990 |
| JP | 2-258116 | 10/1990 |

* cited by examiner

*Primary Examiner*—Lowell A. Larson
(74) *Attorney, Agent, or Firm*—Darby & Darby

(57) ABSTRACT

A method for bending sheet metal includes introducing to the sheet metal thinned regions which are positioned either along or immediately adjacent to a bending line. These thinned regions allow the metal to be easily bent along the bending line using conventional hand tools or non-specialized machines. The thinned regions may be shaped as slots having a specific width, length, end shape, spacing from each adjacent slot, and depth into the metal sheet.

According to one embodiment of the invention, each slot is cut through the entire thickness of the metal sheet. Other related embodiments require that the slots be only partially cut or etched thereby having a depth that is less than the thickness of the metal sheet. The thinned regions may be any appropriate shape as controlled by the shape of the bend, the type of metal, the thickness of the metal, the ductility of the metal, the angle of the bend, and the application of the metal (e.g., load bearing, etc).

According to a second embodiment, two generally parallel sets of thinned regions are formed adjacent and generally parallel to the bending line. In a preferred application, the two sets of thinned regions are slots (cutting through the metal) and are staggered or offset with respect to each other.

35 Claims, 26 Drawing Sheets fig. 11
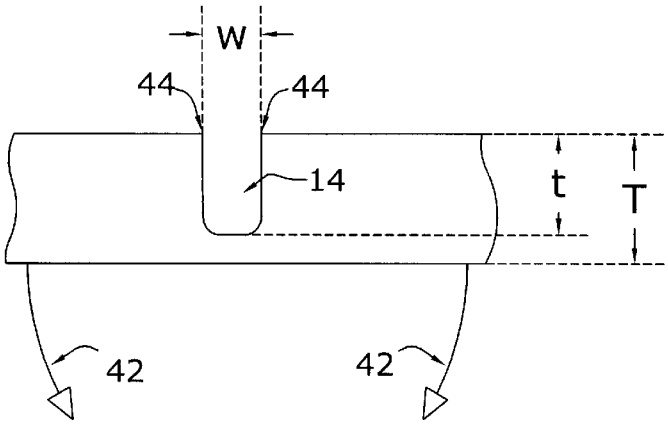
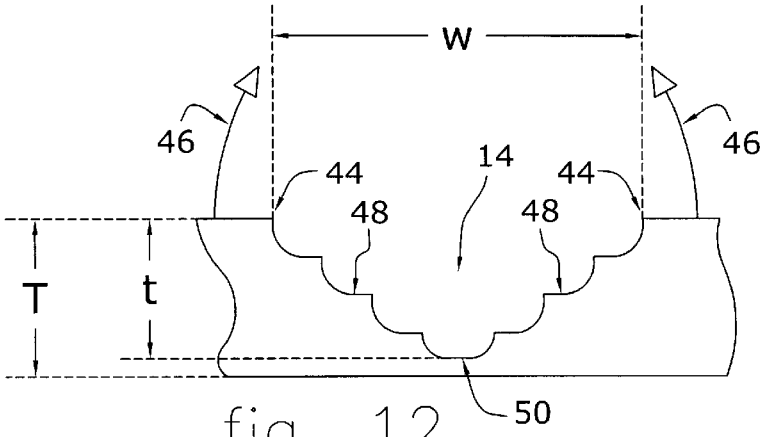
fig. 12
fig. 13
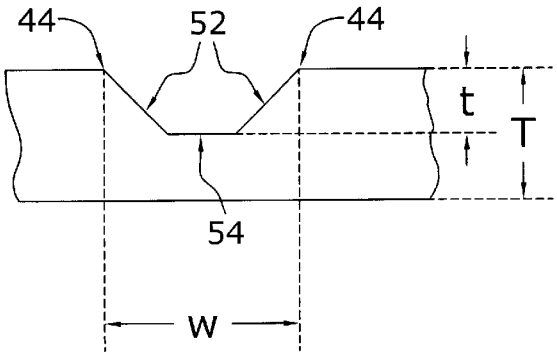
fig. 14
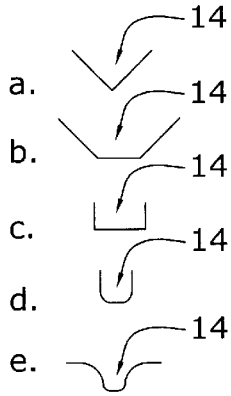

fig. 15a
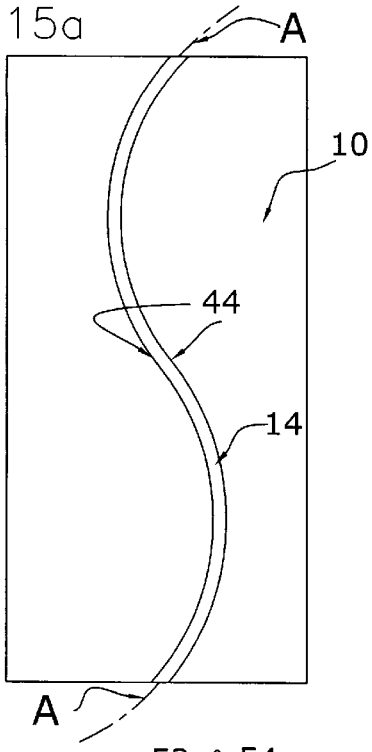
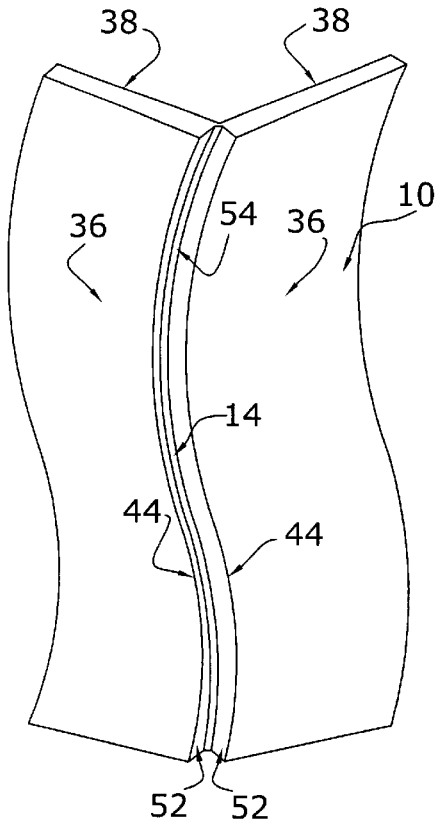
fig. 15b
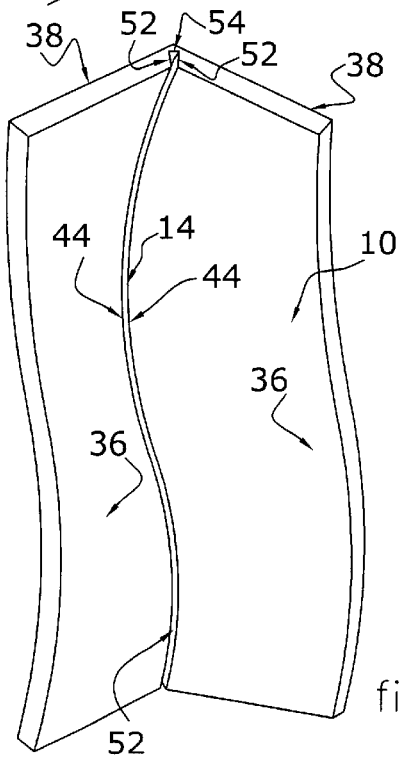
fig. 15c fig. 26a
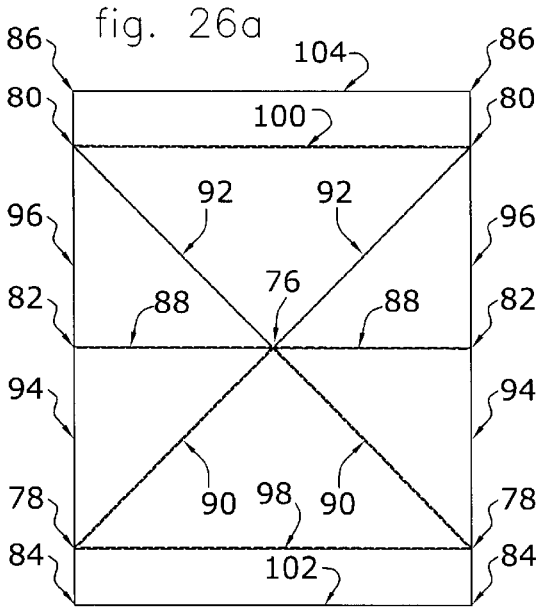
fig. 26e
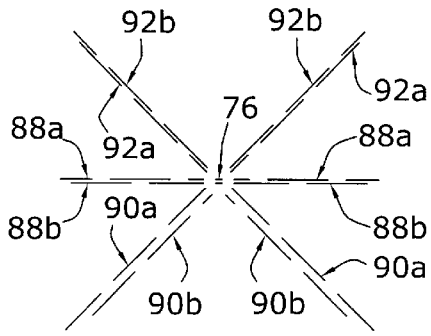
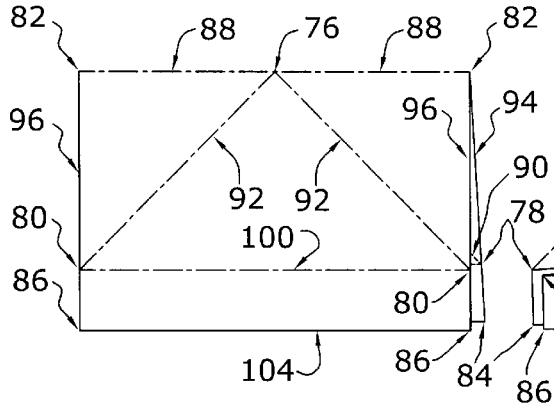
fig. 26b
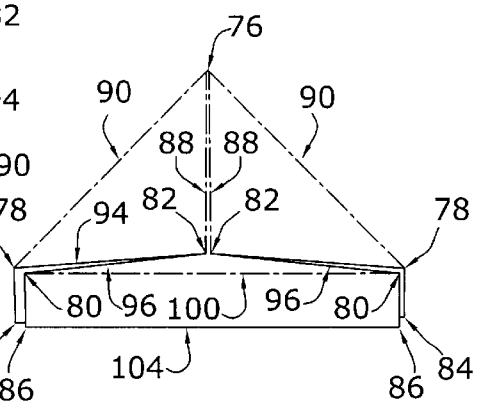
fig. 26c
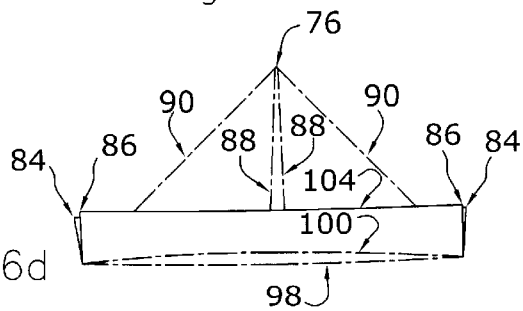
fig. 26d

METHOD OF BENDING SHEET METAL TO FORM THREE-DIMENSIONAL STRUCTURES

This application is a continuation-in-part of patent application having Ser. No. 09/492,994, filed Jan. 27, 2000, now abandoned, which claims priority from provisional patent application, filed Jan. 27, 1999 having Serial No. 60/117,566, the disclosure of which is hereby incorporated by reference.

BACKGROUND OF THE INVENTION

1) Field of the Invention

This invention generally relates to methods for shaping and forming malleable sheet material (e.g., metal sheet), and, more particularly, to a method for bending sheet metal along either straight or curved score lines.

2) Description of the Prior Art

Sheet metal is a commonly used material for a multitude of applications including housings and casings, interior and exterior structures, and various covers and supports. Stock sheet metal is typically supplied to manufactures in the form of flat sheets or rolls of flat stock. The manufacturer uses the stock metal sheet and cuts, shapes, and bends the metal, as necessary, to manufacture various products.

Bending sheet metal is conventionally accomplished using either hand tools and/or forms, or bending machines including press and box brakes, and roll embossing machines, depending on the type of bend being performed and the desired results. Although sheet metal may be bent along a line which is either straight or curved, bending along curved lines requires specialized tooling to support the metal sheet on one side of the bending line, and also encourage the metal located on the opposing side of the bending line to bend along the curved line. Depending on the specific shape of the bending line, heat may be necessary to discourage distortion. Not only is this curve-line tooling costly and time-consuming, customizing it to the particular bend, the resulting tooling is also unique to each specific curve, and therefore may have a limited usefulness (i.e., only useful in bending a piece of metal along one specific shape curve).

Computers are used to control many metal-forming and metal cutting machines quickly and accurately. One such computer-controlled machine is a laser cutter wherein a laser beam of high energy is controlled by a computer and guided along one surface of metal sheet. The laser energy quickly and accurately cuts or etches the metal sheet, as controlled by the computer and as prescribed by software. Another type of cutting and etching machine uses a powerful stream of water, usually including an abrasive. The resulting water-jet is carefully controlled to abrade through metal sheet. The water-j et system allows for accurate cut lines or etched lines having a prescribed depth. Another software-driven technique involves scribing or milling the metal with a hard cutting tool driven by a computer.

It is an object of the invention to provide a method for bending sheet metal, which overcomes the deficiencies of the prior art.

Another object of the invention is to provide such a method for bending sheet metal wherein the bending line is curved in one or more directions.

Another object of the invention is to provide a method for bending sheet metal along a curved bending line wherein bending stress to the metal is minimized and controlled to minimize metal fatigue and distortion.

Another object of the invention is to provide a method for bending sheet metal to form 3-dimensional structures for architecture.

SUMMARY OF THE INVENTION

Accordingly, a method for bending sheet metal is disclosed which includes introducing to the sheet metal thinned regions which are positioned either along or immediately adjacent to the bending line. These thinned regions allow the metal to be easily bent along the bending line using conventional hand tools or non specialized machines. The thinned regions are preferably shaped as slots cutting through the metal and having a specific width, length, end shape, and spacing from each adjacent slot. In some instances, the slots have a depth into the metal sheet. In other instances, the thinned regions with a depth are continuous.

According to one embodiment of the invention, each slot is cut through the entire thickness of the metal sheet. This embodiment is particularly useful for building structures on an architectural scale. Other related embodiments require that the slots be only partially cut or etched, thereby having a depth that is less than the thickness of the metal sheet. Etched slots of this kind are particularly useful for thinner sheet metals. The thinned regions may be any appropriate shape depending on the shape of the bend, the type of metal, the thickness of the metal, the ductility of the metal, the angle of the final bend, and the application of the metal (e.g., is the metal structure intended to be load bearing, etc).

According to a second embodiment, two generally parallel sets of thinned regions are formed adjacent and generally parallel to the bending line. Each set may include different types of thinned regions to encourage bending of the metal along the bending line. The thinned regions are preferably slots that cut through the metal sheet. In a preferred application of this second embodiment, the two sets of slots are staggered or offset with respect to each other. This embodiment is also particularly useful for building structures on an architectural scale.

According to a third embodiment, a continuous thinned region that has a depth less than the thickness of the metal is used instead of interrupted aligned or staggered slots. This has aesthetic as well as practical advantages since there are no cut regions that need to filled in.

The thinned regions may be introduced into the metal sheet using conventional machines or computer-driven machines such as a laser cutting machine or a water jet-cutting machine or other softwareware-driven devices which enable grooving or selective weakening of metal through other means. These machines are capable of either cutting completely through the metal sheet, or just etching the thinned regions only partially through the metal sheet, as required. Also, these machines are capable of accurately cutting along lines which may be straight and/or curved.

While specific embodiments have been described herein, it will be clear to those skilled in the art that various modifications and changes may be made without departing from the spirit and scope of the present invention.

BRIEF DESCRIPTION OF THE DRAWINGS

FIG. 11 is a sectional side view of a metal sheet showing details of a thinned region suitable for an outside bend, according to the invention;

FIG. 12 is a sectional side view of a metal sheet showing details of a thinned region suitable for an inside bend, according to the invention;

FIG. 13 is a sectional side view of a metal sheet showing details of a thinned region having a sectional shape including a flat floor and two angled side walls, according to the invention;

FIGS. 14*a*–14*e* are exemplary sectional shapes suitable for the thinned region shown in FIG. 13, including a V-shape, a V-shape with a wide floor, a straight-walled shape, a U-shape, and a U-shape with curved walls;

FIGS. 15*a*–*c* show a plan view and perspective views after bending of a metal sheet with a continuous thinned region along a doubly-curved bending line, according to the third embodiment of the invention;

FIGS. 26*a*–26*e* show a sheet metal pattern for an origami design.

DETAILED DESCRIPTION OF A PREFERRED EMBODIMENT

Figure 1:
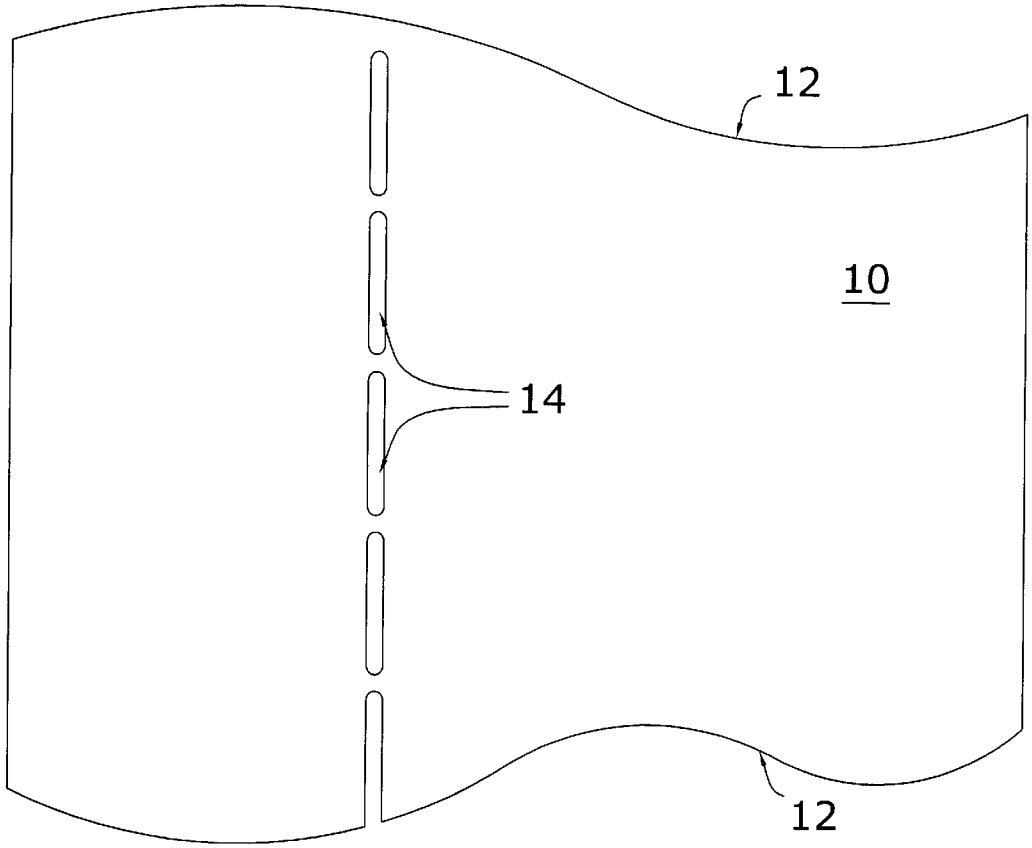
FIG. 1 is a plan view of a metal sheet showing thinned regions, according to a first embodiment of the invention.
Figure 2:
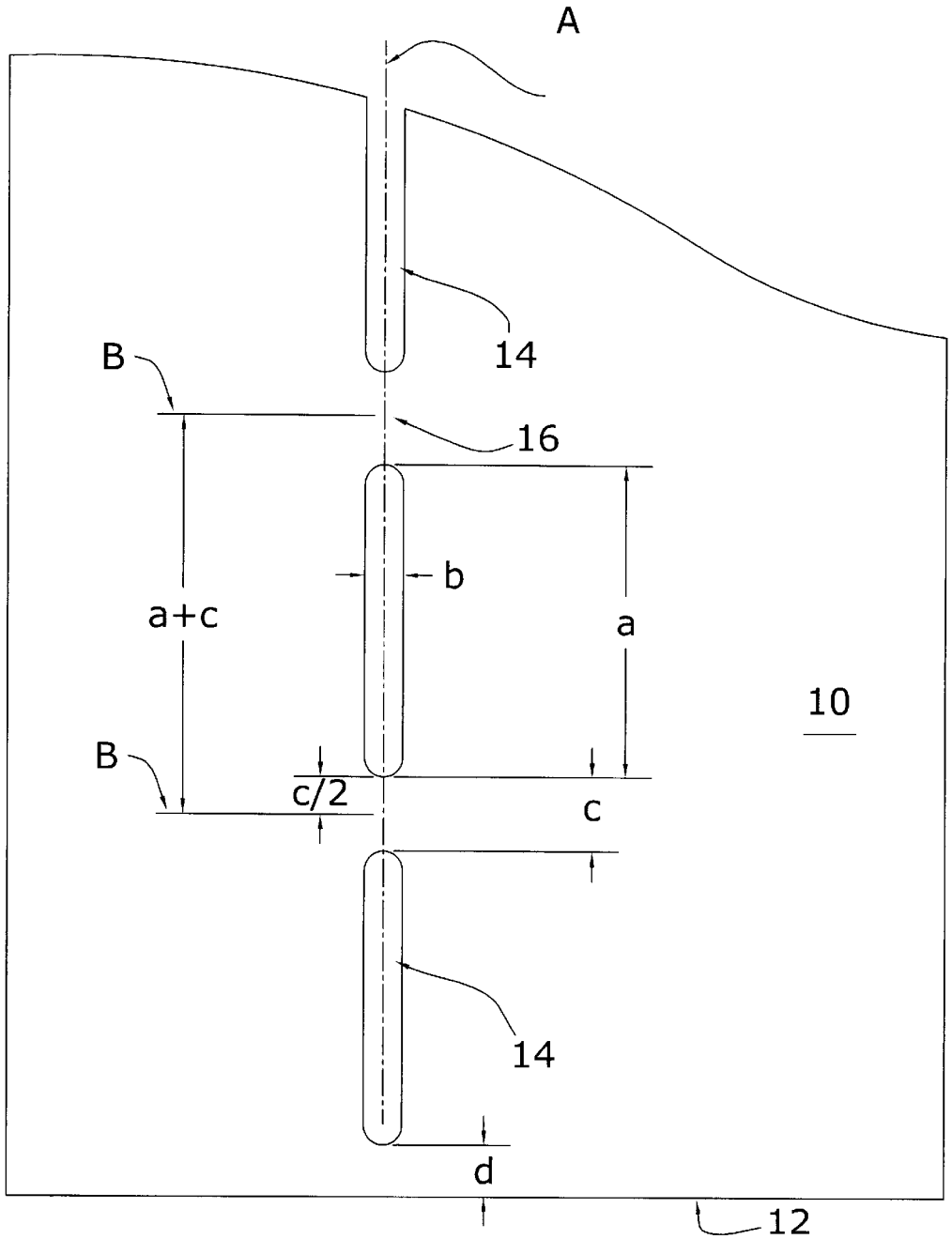
FIG. 2 is an enlarged partial view of the metal sheet of FIG. 1, according to the first embodiment of the invention.

Referring to FIGS. 1 and 2, a partial plan view of a metal sheet 10 having an edge 12 is shown including a bending line (or score line) "A", and a plurality of thinned regions 14, shown as slots in these figures. According to this first embodiment, a single "aligned" row of thinned regions (slots) 14 is formed into metal sheet 10 directly along bending line A. According to this embodiment, thinned regions 14 are cut entirely through metal sheet 10, and thereby collectively form a perforated line which is coaxial with bending line A.

Thinned regions 14 in this embodiment have a length equal to "a" (in FIG. 2), a width equal to "b", and are spaced from each other a distance equal to "c", defining intermediate connections 16 which are located between any two adjacent thinned regions 12. Intermediate connections 16 function literally as hinges about which the metal sheet on either side of the bending line A may bend. The distance b has a minimum determined by k thickness, the thickness of the cutting device, e.g. the width of the laser beam or the water jet. Currently available technology sets k equal to 0.003" for the laser beam and a range between 0.003" and 0.042" for the water jet.

Figure 6:
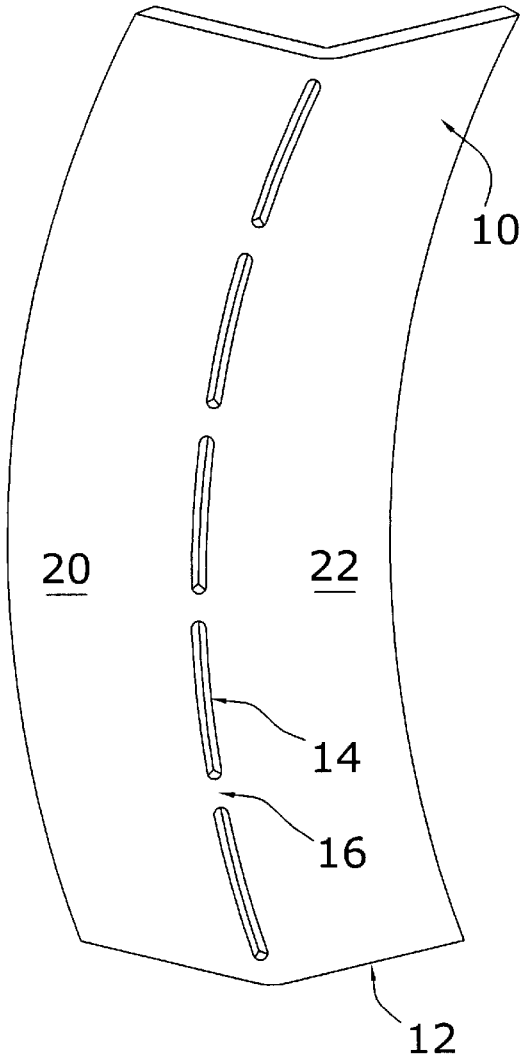
FIG. 6 is a perspective view of the metal sheet of FIG. 5 after being bent along the curved bending line, according to the invention.

Regardless of their particular dimensions, thinned regions 14, according to this embodiment, are centered or "aligned" along bending line A, as indicated in FIG. 2, and function to encourage metal sheet 10 to bend along bending line A which may be straight, as shown in FIG. 2, or curved, as shown in FIG. 6, and discussed in greater detail below.

Thinned regions 14 may be etched in metal sheet 10, so they do not extend entirely through metal sheet 10. In this embodiment, thinned regions 14 are etched and extend a distance "t" into metal sheet 10, wherein t is less than the thickness T of metal sheet 10. Thinned regions may be any shape including slots, circles, triangles, and in the case where t is less than the thickness of the metal sheet, thinned regions may be a single continuous etched score line or groove of a predetermined width and depth. This method of continuous grooving is equivalent to setting c=0 in FIG. 2.

Figure 3:
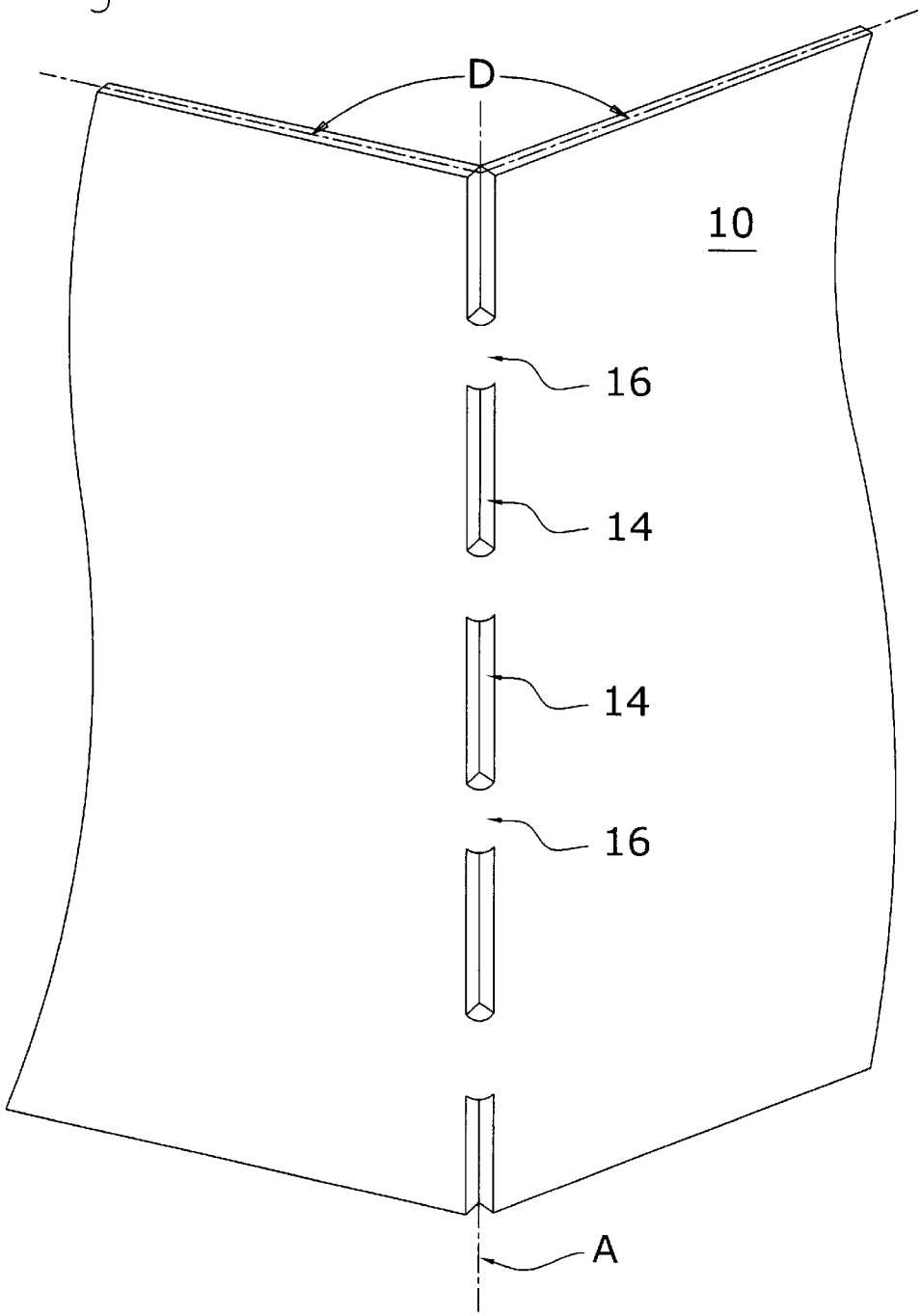
FIG. 3 is a perspective view of the metal sheet of FIG. 1, after being bent along a bending line, according to the first embodiment of the invention.
Figure 4:
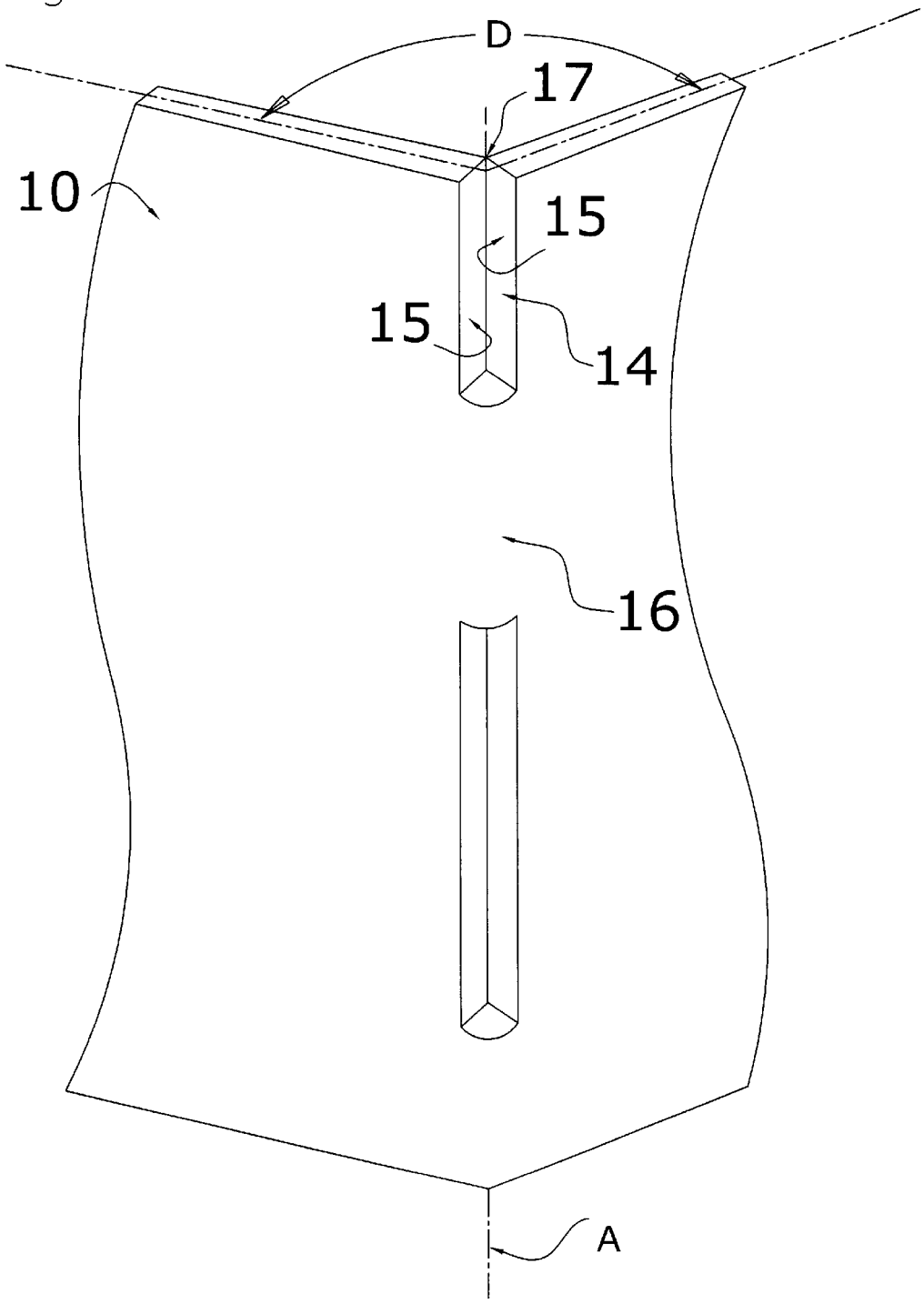
FIG. 4 is an enlarged partial view of the bent metal sheet of FIG. 3.

Referring to FIGS. 3 and 4, metal sheet 10 is shown bent along bending line A at an angle "D". Once a metal sheet 10 is provided with thinned regions 14 located along the bending line A, the metal sheet 10 may be easily bent along the bending line A using conventional hand tools (or in some cases, simply by hand) into a 3-dimensional structure, as shown in FIG. 3.

The ductility and thickness T of the metal sheet 10 may limit the maximum bending angle D. This is apparent in FIG. 4, wherein thinned regions 14 are shown to include side walls 15 which abut each other at a predetermined angle D along an inside edge 17. By providing thinned regions 14 along the bending line A, much of the stress exerted to the metal sheet during bending is focused at the intermediate connections 16. This is especially helpful when the bending line A follows a curved path, as described below.

During bending, once the opposing sidewalls 15 of each slot or thinned region 14 contact each other, any further bending of the metal sheet 10 along the bending line A (i.e., decreasing angle D), the metal will begin to stretch at the intermediate connections 16. At this point, the metal sheet 10 may be further bent (decreasing angle D) if the metal is sufficiently ductile, otherwise, the metal may stress fracture at the intermediate connections 16 and the bend will fail. To help discourage metal failure at these connecting points, intermediate connections 16, may too be thinned in a controllable manner using a water-jet, laser-cutting or any other software-driven process.

Referring to FIGS. 1–4, applicant has determined after considerable testing that for a variety of metals including steel, stainless steel, bronze, aluminum, and brass (and similar metals), it is preferred that (refer to FIG. 2):

a is not less than c but not greater than 30 times c, b is greater than 0.002" but not greater than 2 times T, c is not less than T/2 but greater 3 times T.

As an example, if 20 gauge steel sheet is being bent using an aligned bending pattern (shown in FIG. 2), a=0.300", b=0.0070", and c=0.050". These dimensions result in an acceptable bend, similar to that shown in FIGS. 3 and 4. If 16 gauge aluminum is being bent, preferred dimensions for a, b, and c, are: a=0.4375", b=0.060", and c=0.060".

Figure 5:
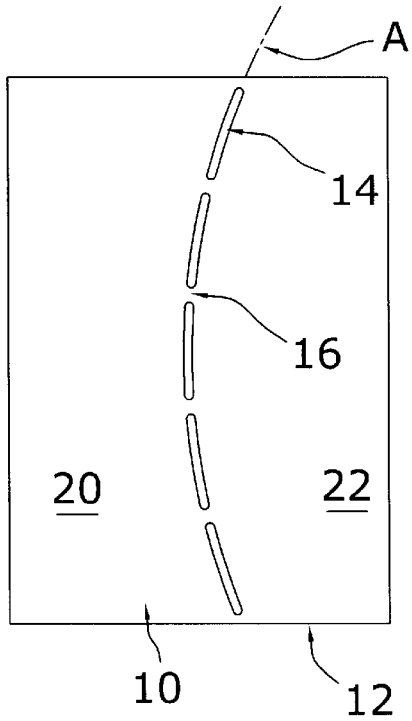
FIG. 5 is a plan view of a metal sheet showing thinned regions following a bending line which is curved, according to the first embodiment of the invention.

Referring to FIGS. 5 and 6, metal sheet 10 includes a bending line A that follows a curved path, and several thinned regions 14 positioned along the curved bending line A. Again, after thinned regions 14 are introduced into metal sheet 10, the metal may be bent along bending line A. Since the bending line A is curved, one side 20 of metal sheet 10 follows a curved plane having a convex shape, while the opposing side 22 of metal sheet 10 follows a curved plane which is concave, as shown in FIG. 6. The preferred ranges of values of a, b and c given above are similar for curved bending.

Figure 6A:
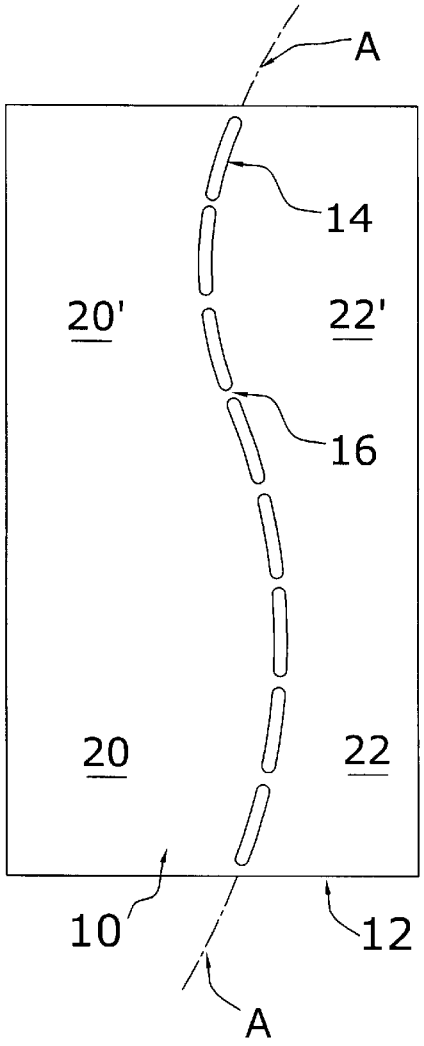
FIGS. 6*a* and 6*b* show a plan view and a perspective view after bending of a metal sheet with thinned regions located along a doubly-curved bending line, according to the first embodiment of the invention.
Figure 6B:
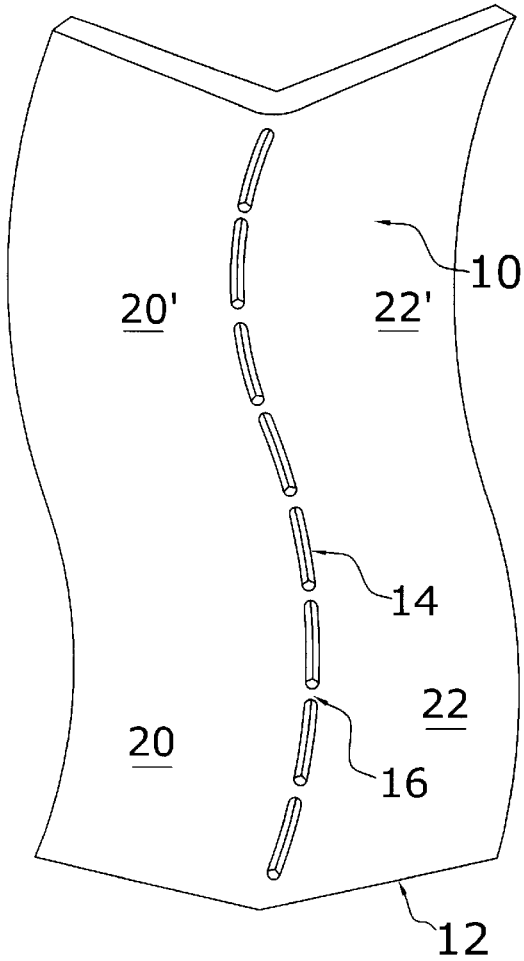

FIGS. 6*a* and 6*b* are similar to FIGS. 5 and 6, respectively, but show a curved bending line A having a convex and a concave curvature. Several thinned or slotted regions 14 are positioned along the curved bending line A. Again, after thinned regions 14 are introduced into metal sheet 10, the metal may be bent along bending line A. Since the bending line A is curved in two opposite directions, the lower and upper halves of the metal sheet are curved in an opposite manner. In FIG. 6*b*, the lower half side 20 of metal sheet 10 follows a curved plane having a convex shape, while the opposing side 22 of metal sheet 10 follows a curved plane which is concave. In the upper half, the side 20 follows a concave curved plane while the opposing side 22 follows a convex curved plane. The transition from convex to concave on one side makes this a more complex type of bending than the singly-curved bending. The preferred ranges of values of a, b and c given earlier for straight and singly-curved bending are similar for doubly-curved bending.

Figure 7A:
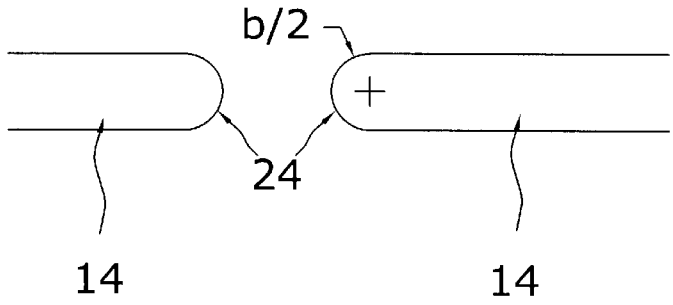
FIGS. 7*a*–7*d* are plan partial views of thinned regions, showing details of various end cuts, according to the invention.
Figure 7B:
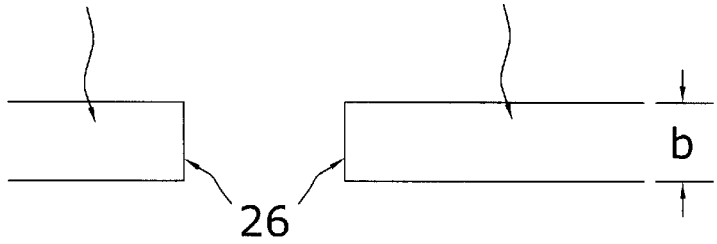
Figure 7C:
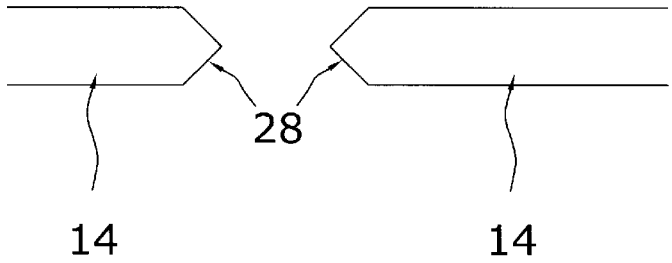
Figure 7D:
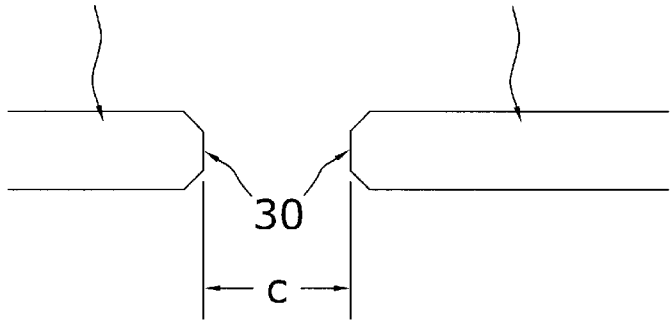

Referring to FIGS. 7*a*–7*d*, several examples of shaped ends of the thinned regions 14 are shown including a simple rounded end 24, shown in FIG. 7*a*, a squared-off end 26, shown in FIG. 7*b*, a diagonal end 28, shown in FIG. 7*c*, and a truncated diagonal end 30 (chamfered), shown in FIG. 7*d*. Each of these ends may be used with each thinned region 14 to create desired bending characteristics of metal sheet 10 along bending line A, and prevent tearing of the metal along any of the intermediate connections, depending on the specific parameters of the metal and intended bend, listed above.

Rectangularly shaped ends (see FIG. 7*b*) tend to be weaker than the other types of cut ends, shown in FIGS. 7*a*, 7*c*, and 7*d*, wherein broader regions of metal are used to connect the sides of a slot with the intermediate connections. However, the time required to cut each end of each slot is dependent on the particular shape. The rectangularly shaped cut end, shown in FIG. 7*b* requires less time (and is therefore less costly) to cut than do the cut ends shown in FIGS. 7*a*, 7*c*, and 7*d*.

Figure 7E:
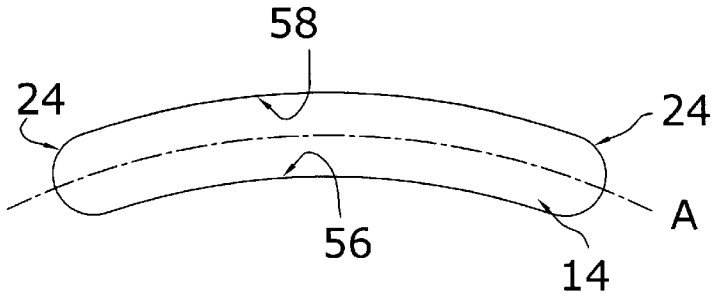
FIGS. 7*e*–*g* are alternative shapes of curved thinned regions around a curved bending line.
Figure 7F:
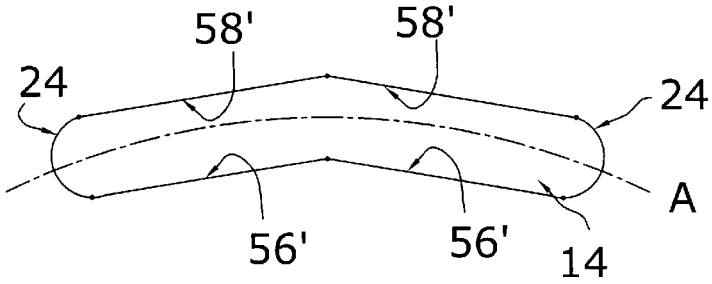
Figure 7G:
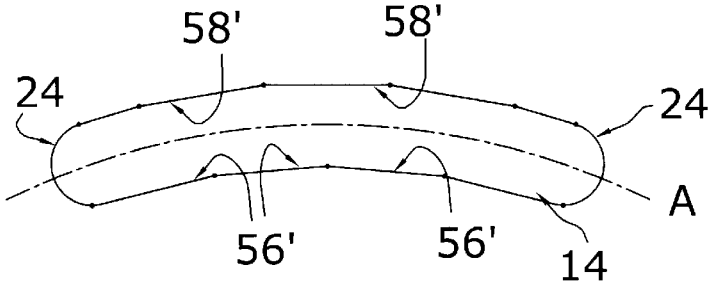

Referring now to FIGS. 7*e*–*g*, some alternative shapes of thinned regions or slots for curved bending are shown. The region 14 around curved bending line A has curved ends 24 in the three examples shown, but the side walls of 14 are different. In FIG. 7*e*, the side wall are smooth curves 56 and 58, in FIG. 7*f* the side walls are composed of a pair of straight line segments 56 and 58, and in FIG. 7*g* the side wall comprises a multiple number of straight line segments 56 and 58.

Figure 8:
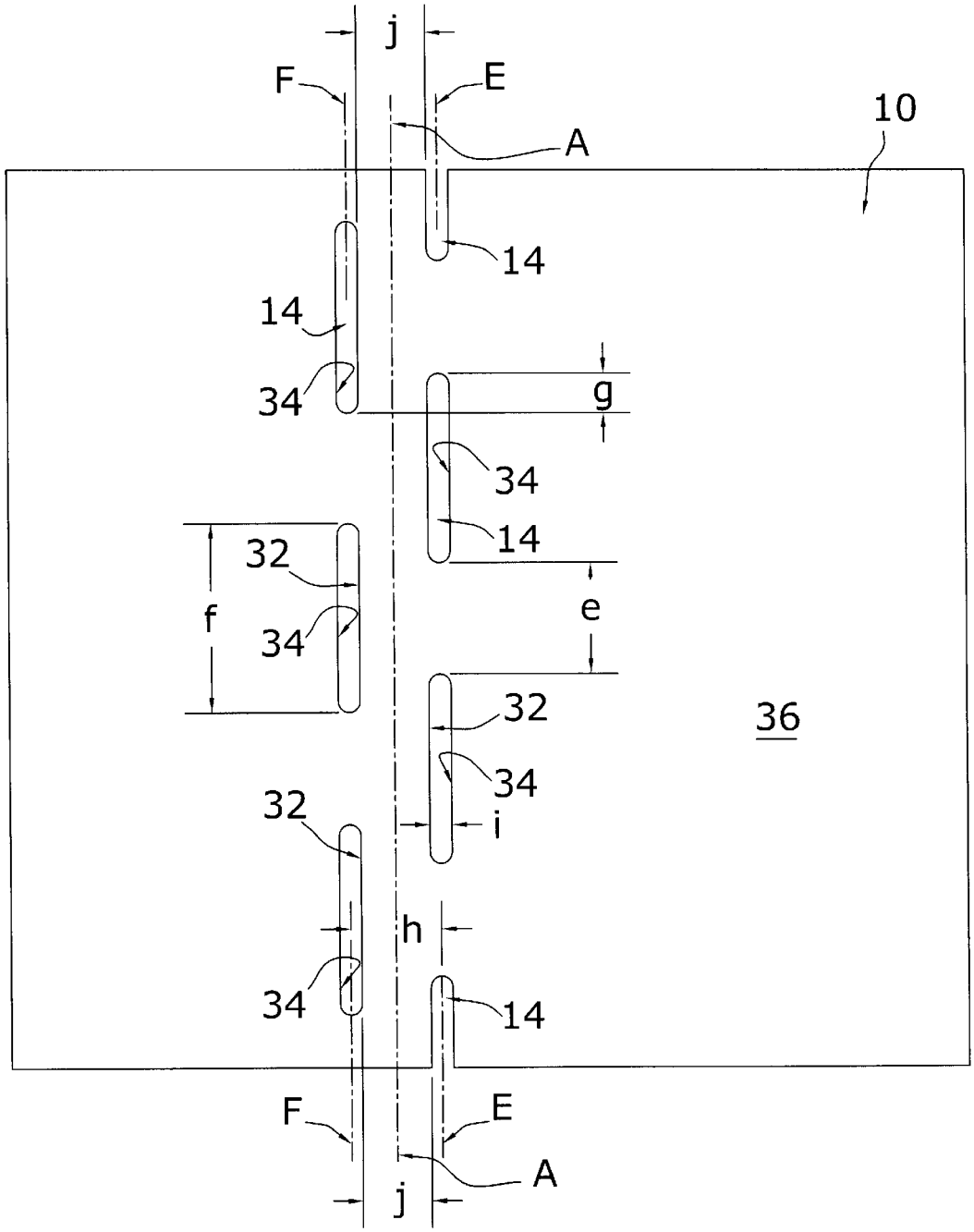
FIG. 8 is a plan view of a metal sheet, showing a bending line, and a staggered arrangement of thinned regions, according to a second embodiment of the invention.
Figure 9:
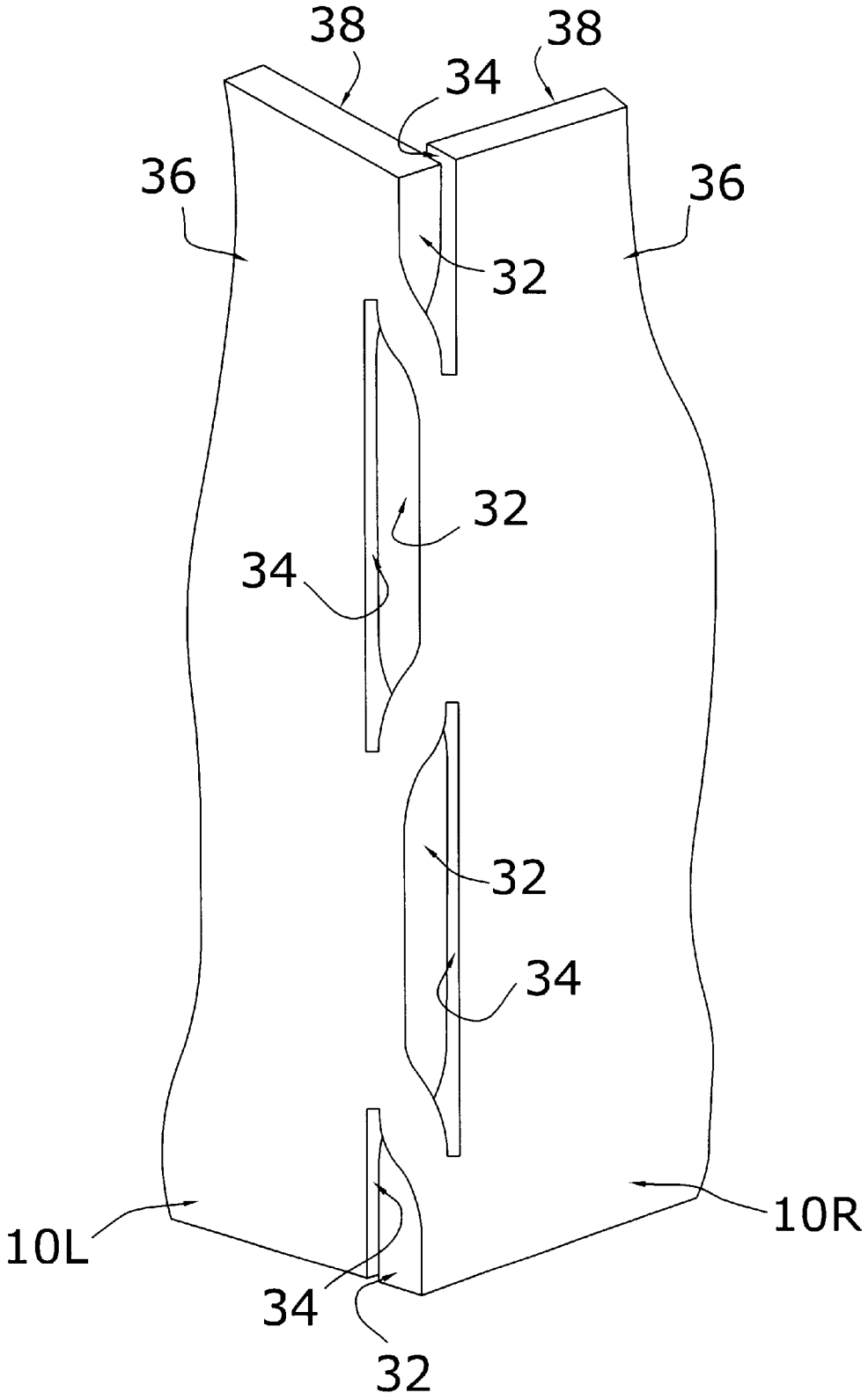
FIG. 9 is a perspective view of the metal sheet of FIG. 8 after being bent along the bending line, according to the second embodiment of the invention.

Referring now to FIGS. 8 and 9, another embodiment of the invention is shown including a metal sheet 10 and a bending line A. According to this embodiment, a staggered arrangement of thinned regions 14 is positioned generally along bending line A. The staggered arrangement includes thinned regions 14 on each side of bending line A defining two parallel lines-of-weakness E and F, located adjacent to and offset from bending line A. Each thinned region 14, (as in the above-described embodiment of the invention shown in FIGS. 1–2) includes a length "f", a width "i", and an intermediate distance "e". Line-of-weakness E is positioned a distance "h" from line-of-weakness F, one on each side of bending line A. According to this embodiment of the invention, thinned regions 14 along line-of weakness E are staggered or offset with respect to corresponding thinned regions 14 located along line-of-weakness F as defined by the overlap distance "g", and as shown in FIG. 8. Each thinned region 14 further includes an inner sidewall 32 ("inner" being adjacent to or closer to bending line A), and an outer sidewall 34 ("outer" being remote or further from bending line A). Metal sheet 10 includes a front surface 36 and a rear surface 38. The critical control distance that permits the offset bending is the distance j between the two inner side walls 32 on either side of the bending line A. Bending is possible when j equals T, the thickness of the metal, or when j is greater than T. The minimum value for i equals k, the thickness of the cutting device, for example, the width of the laser or the water jet.

Figure 10:
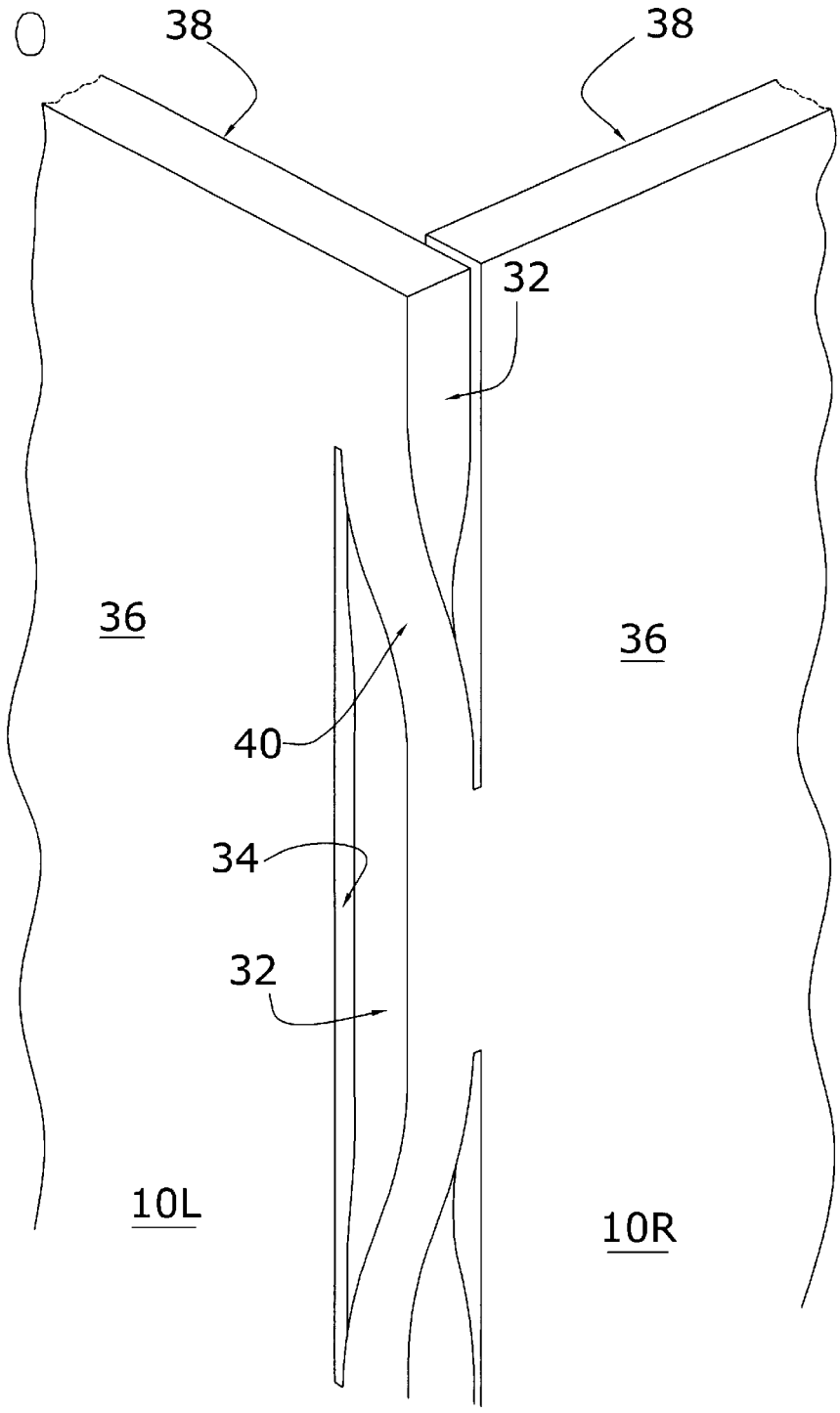
FIG. 10 is a enlarged perspective view of FIG. 9, showing details of a close-fitting bend and twisted portions.

Metal sheet 10 of FIG. 8 is bent along bending line A, using similar techniques used to bend metal sheet 10 of FIG. 1, described above. The resulting bend is shown in FIG. 9 and an enlarged view is shown in FIG. 10. The bend formed along a bending line A, defines a section 10L on the left side of bending line A, and a section 10R located on the right side of bending line A. In this embodiment, distance h is equal to the thickness. T of the metal sheet 10 plus distance "i" so that upon bending, a portion of the metal sheet located between inner sidewall 32 and bending line A will twist, as shown in FIGS. 9 and 10, defining twisted portion 40, so that an outer sidewall 34 of each thinned region 14 of section 10L distorts to abut against the rear surface 38 of section 10R, and similarly, the outer sidewall 34 of each thinned region 14 of section 10R will twist to abut against the rear surface 38 of section 10L, thereby forming a strong, tight and sharp bend along bending line A. Inner sidewall 32 of each thinned region will twist to become exposed along the bending line A and coplanar with each respective front surface 36, as shown in FIG. 10.

The embodiment shown in FIGS. 9 and 10 show a bend of about 90 arc degrees about bending line A so that each outer side wall 34 abuts flush with rear surface 38 of each respective section 10L, 10R, as described above, however, metal sheet 10 may be bent about bending line A to any angle. Any angle, including 90 degrees will cause each outer side wall 34 to make contact with the opposing respective section 10R, and 10L so that a tight bending joint is formed.

Figure 10A:
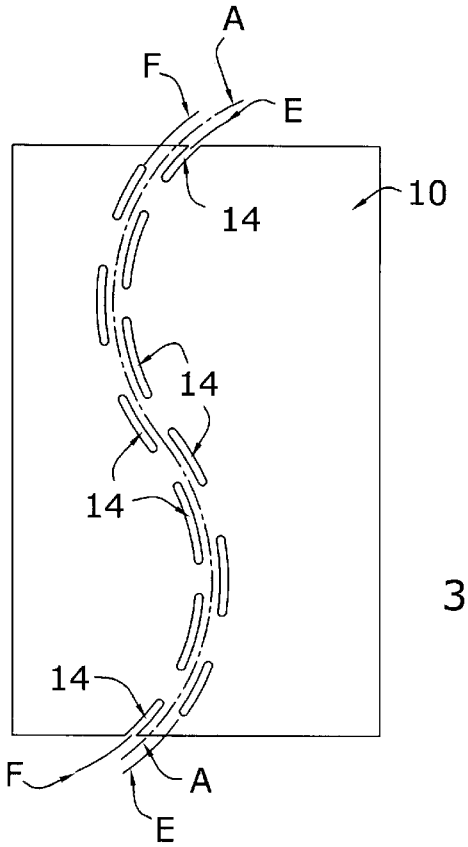
FIGS. 10*a* and 10*b* are a plan view and a perspective view after bending of a metal sheet with offset thinned regions around a doubly-curved bending line, according to the second embodiment of the invention.
Figure 10B:
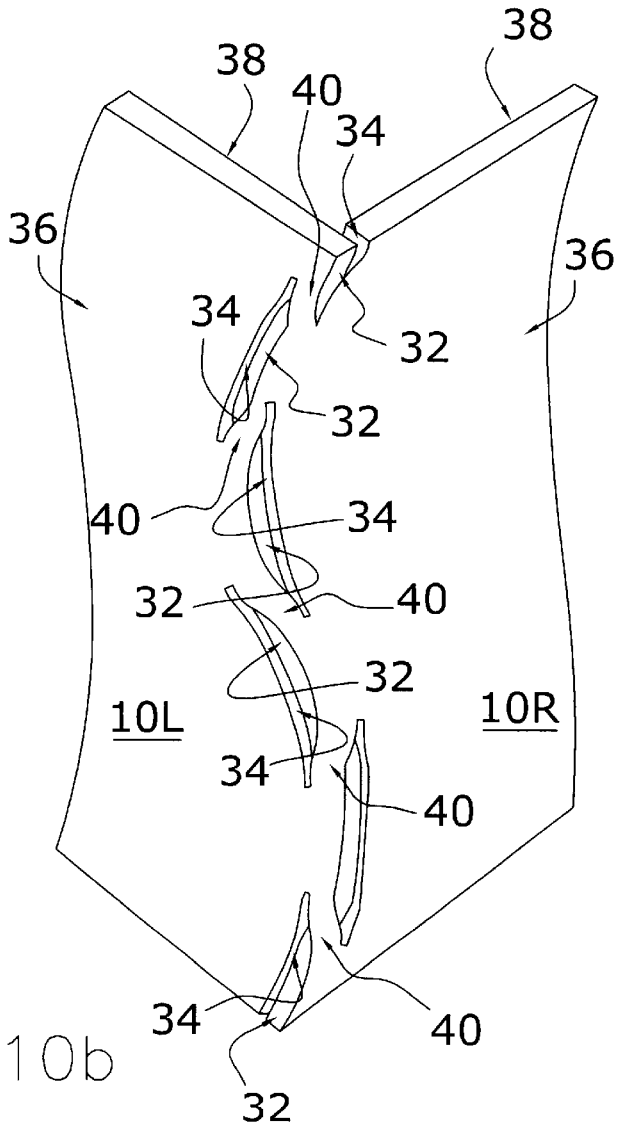

FIGS. 10*a* and 10*b* are similar to FIGS. 6*a* and 6*b*, respectively, but show the staggered thinned regions along a doubly-curved bending line A having a convex and a concave curvature. The bending in FIG. 10*b* is similar to that in FIG. 6*b* with similar locations of convex curved planes 20 and 22' and concave curved planes and 20' and 22. The details of curved bending in FIG. 10*b* are similar to straight bending in FIGS. 9 and 10. The side wall 34 abuts flush with rear surface 38, side wall 32 abuts flush with front surface 36, and the two portions 10L and 10R of the front surface 36 remain continuous after bending through twisted portion 40. The preferred ranges of values of e, f, g, h and i given earlier for straight and singly-curved bending are similar for doubly-curved bending.

Figure 10C:
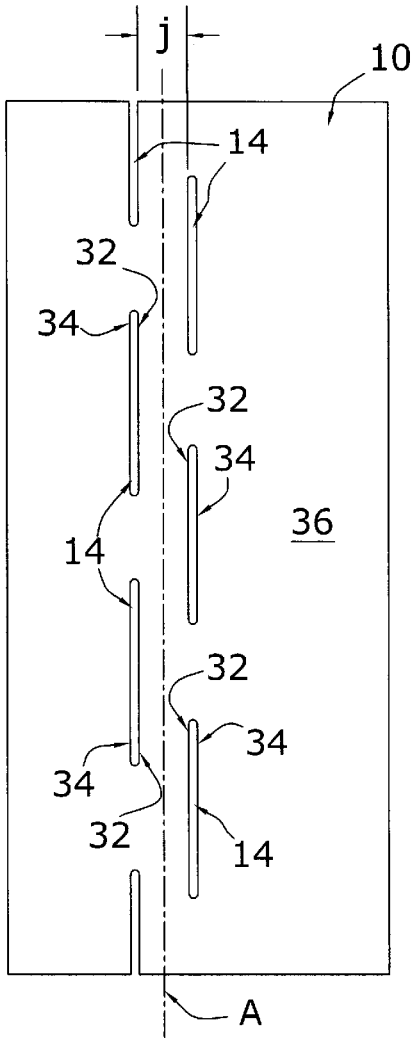
FIGS. 10*c* and 10*d* are a plan view and a perspective view after bending a metal sheet with offset thinned regions spaced apart at a distance more than twice the thickness of the metal.
Figure 10D:
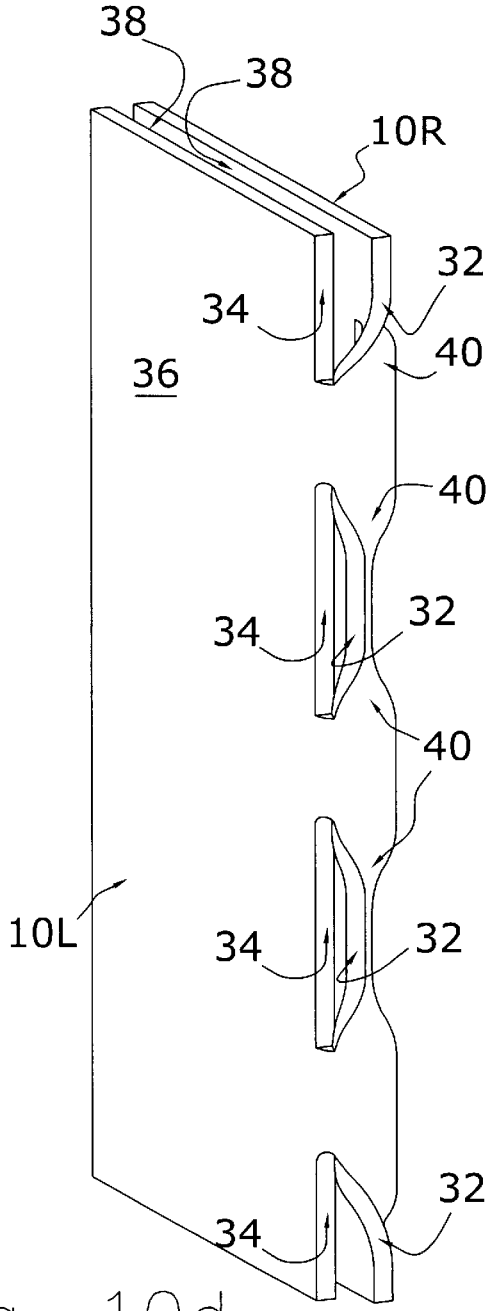

FIGS. 10*c* and 10*d* show a variation of the offset thinned regions where the distance j between the inner side walls 32 of the opposing slots 14 on either side of the bending line A is greater than the thickness of the metal T. In the example shown, j is more than two times T. This permits the metal to fold over itself as shown in FIG. 10*d* and revealing the inner and outer side walls 32 and 34. The twisted regions 40 are broader too as compared with the twisted regions in FIG. 10 where j equaled T.

Figure 10E:
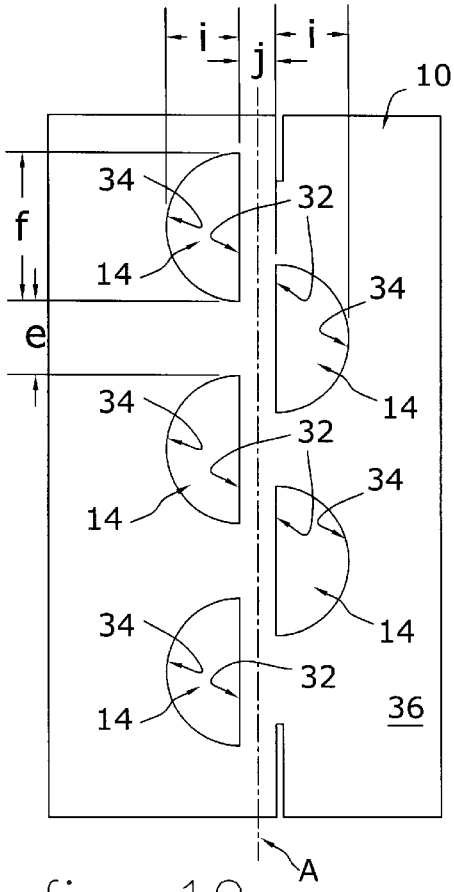
FIGS. 10*e* and 10*f* are a plan view and a perspective view after bending a sheet metal with offset thinned regions where the shape of the slots are semi circular.
Figure 10F:
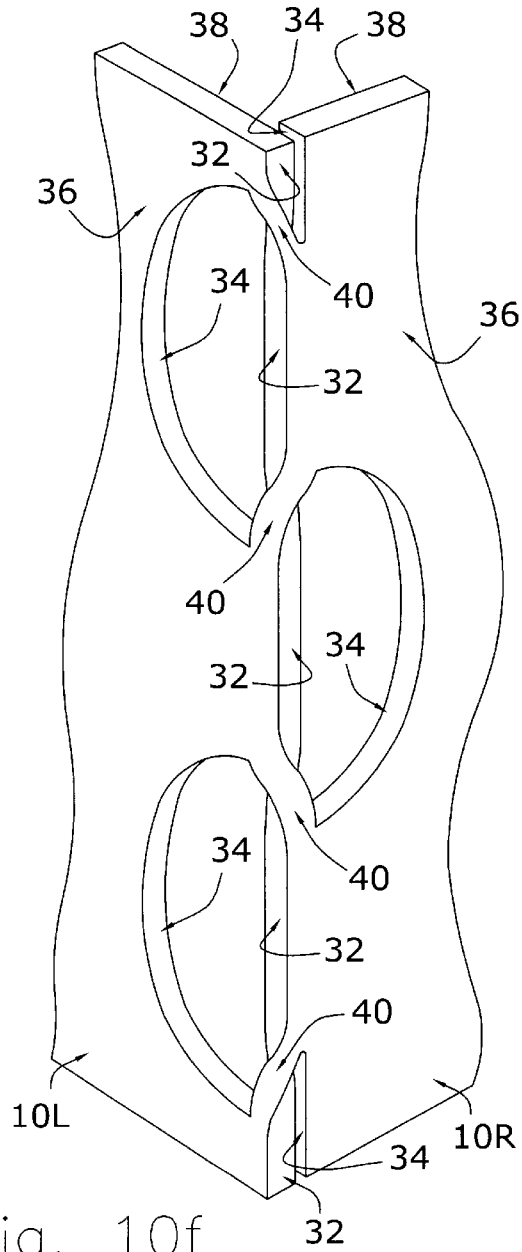

FIGS. 10*e* and 10*f* show another variation of the offset thinned regions method. Here the slots 14 are shaped as semi-circles. Referring to FIG. 10*e* and comparing with FIG. 8, the semi-circular slots have a length of, width i and are separated by a distance e along the length. The inner side walls 32 of opposing slots are straight and remain parallel to the bending line A, while the outer side walls 34 are curved. The distance between the inner side walls j equals T in this illustration, and i represents the width at the maximum point on the curve. In FIG. 10*f*, the inner and outer walls of the slots are clearly revealed. The slots are separated by twisted regions 40, as in FIG. 10.

The present invention generally described three different types of metal thinning; "aligned" metal thinning wherein thinned regions, preferably slots, are aligned along a bending line, "offset" metal thinning wherein thinned regions, also preferably slots, are positioned in a staggered arrangement on either side of a bending line, and "continuous" metal thinning wherein thinned region is continuous along bending line and has a depth less than thickness of metal. This third method is equivalent to the "aligned" metal thinning where the space between thinned regions equals zero. Applicant has determined that the "aligned" thinning technique is useful to bend relatively thin metal have a thickness less than or equal to 0.06 inches. Metal sheet having a thickness greater than 0.06 inches requires the use of the "offset" thinning technique, unless the angle of bend is slight (a shallow obtuse angle) at which point either technique may be used effectively. The thickness of the metal generally determines which of these two thinning techniques should be used. Continuous thinning, also termed "grooving", is guided by aesthetic and functional considerations in addition to metal thickness. It is also more suitable for water-jet cutting, while "aligned" and "offset" techniques are more suited to laser-cutting.

For offset bends (see FIG. 8), applicant has determined after considerable testing that for steel, bronze, aluminum, and brass (and similar metals), it is preferred that:

f is not less than 3 times T, i is not less than k (or 0.003", for example, based on the current thickness of the laser beam or water jet), e is not less than T, j is not less than T g is not less than T but not greater than 4 times T.

As an example to offset bend a sheet of 20 gauge steel (as shown in FIGS. 8 and 9), acceptable dimensions for e, f, g and i: e=0.3333", f=0.6667", g=0.1667", and i=0.007". These dimensions will create a bend in the steel similar to the bend shown in FIG. 9.

As described above, either aligned metal thinning, as shown in FIGS. 1 and 2, or offset metal thinning, as shown in FIG. 8, may extend through the total thickness of the metal sheet, forming a slot, or may extend only a predetermined depth within the metal sheet less than the total thickness thereby forming a recess. In the latter instance, referring to FIGS. 11, 12 and 13, it is preferred to provide thinned regions with specific sectional shapes having width w and depth t as shown, depending on the direction of the desired bend. For example, if the bend is an outward bend, (i.e., bent in the direction of arrows 42 in FIG. 11) it is preferred to form the recess thinning region 14 on the outside corner of the bend so that edges 44 of thinning region 14 do not contact each other and limit the angle of bend. If, for example, the bend is an inward bend (i.e., bent in the direction of arrows 46 in FIG. 12), the recess thinning region 14 must be stepped, as shown, by making several stepped cuts forming a recess having two angled side walls 48 converging at an apex 50 (which is preferably aligned along the bending line A). In the case of stepped recess, the width w is several times the width in the unstepped recess. By shaping the recess thinning region 14 in this manner, the metal sheet may be bent along the apex 50 in the direction of arrows 46 to a maximum angle before side walls 48 finally contact each other and prevent further bending (without distorting or otherwise bulking the metal sheet). The stepped recess thinning region 14 accommodates the bend and provides a predictable and accurate bent edge.

Referring to FIG. 13 and FIGS. 14*a*–14*e*, when the thinning region 14 is formed as a recess, as discussed above and shown in FIG. 12, the thinning region 14 make take on a variety of sectional shapes, each of which may provide different esthetic characteristics of the bend, and may further aid in achieving certain types of bends. FIG. 13 and FIG. 14*b* both show a recess thinning region 14 having a sectional shape including two diverging side walls 52 and a floor 54. This sectional shape for the recess thinning region 14 will accommodate a large inward bending angle without buckling, and works well in outward bends as well.

FIG. 14*a* shows a sectional shape of a recess thinning region 14 which is similar to the shape shown in FIG. 14*b* and FIG. 13, but there is no floor 54, only two side walls forming a V-shape. The maximum angle allowed using this sectional shape is limited by the angle of the side walls of the V-shape (without buckling or distortion). Outward bends may be used with this sectional shape.

FIG. 14*c* shows a sectional shape of a recess thinning region 14 which is similar to that of FIG. 11, and is suitable for outward bends or small inward bends.

FIG. 14*d* shows a similar sectional shape of a recess thinning region 14 wherein the floor of the recess is rounded, as shown, somewhat U-shaped. Also, the sectional shape shown in FIG. 14*e* is similar to the shape shown in FIG. 14*d*, but edges 44 are rounded. The sectional shape of FIG. 14*e* is preferred since it is easy to create using water-jet abrading machines, and also allows both inward and outward directed bends, leaving smooth edges.

FIGS. 15*a–c* show another embodiment of the invention where the thinned regions with depth "t" as shown in FIGS. 11–14 are continuous along the bending line. In FIG. 15*a*, the continuous thinned region 14 having edges 44 and divergent side walls 52 similar to FIG. 13 is doubly curved around the bending line A. In FIG. 15*b*, the metal sheet is bent at a convex angle such that the side walls 52 diverge away from each other. In FIG. 15*c*, the metal sheet is bent at a concave angle such that the side walls 52 converge towards each other. In both cases, the surface of the metal bends in a manner similar to FIG. 6*b*. The angle between the side walls 52 determines the extent of concave bending.

After considering testing of continuous thinned regions for various types of sheet metals including steel, aluminum and other metals, the applicant has determined that it is preferred that:

w is not less that k (or 0.003", for example, based on the current minimum thickness of water jet), t is not less that T/4 and not greater than 9/10ths of T.

As an example, if 20 gauge steel is being bent using continuous thinned region method (shown in FIGS. 11–15), and w=0.4", t=0.015", the result is an acceptable outward bend shown in FIG. 15*b* which corresponds to the direction of arrows 42 FIG. 11. When w=0.16", t—0.025" and T=0.030", the result is an acceptable inward bend shown in FIG. 15*c* which corresponds to the direction of arrows 46 in FIG. 12.

Regardless of the type of metal thinning technique is used, aligned or offset, interrupted or continuous, any appropriate finishing processes may be used to "finish" the bending joint and the front and rear surfaces of the bent metal sheet, as is well known in the art. These finishing processes include welding brazing, filling, brushing anodizing, chemical etching and conditioning, peening, sand blasting, brushing, buffing, polishing coating and painting.

The above-described techniques for bending metal sheet may be used to create 3-dimensional structures having either straight bending lines and flat faces of metal sheet, or curved bending lines and convex and/or concave shaped faces, or structures having a combination of both. Such structures may include any number of bending lines which are either parallel to any and all other bending lines, or intersect one or more bending lines. A few examples of bending configurations are shown in FIGS. 16–20. The metal bending techniques disclosed in this patent application are particularly useful in the art of metal sculpting and architecture.

Figure 16A:
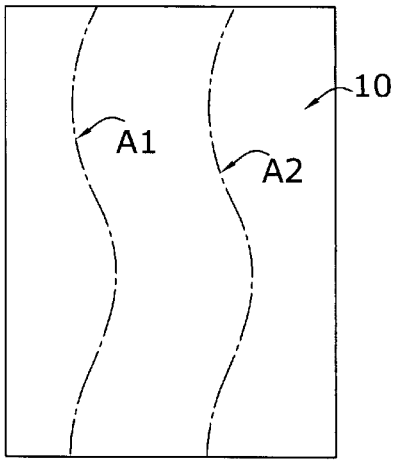
FIGS. 16*a*–*e* show a configuration of parallel doubly-curved bending lines and examples of sheet metal structures obtained after bending.
Figure 16B:
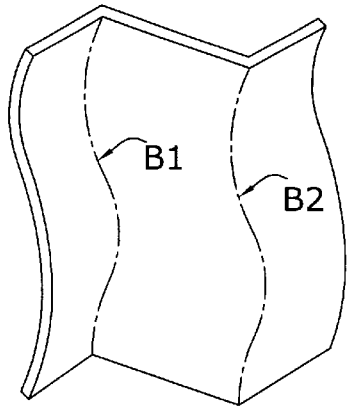
Figure 16C:
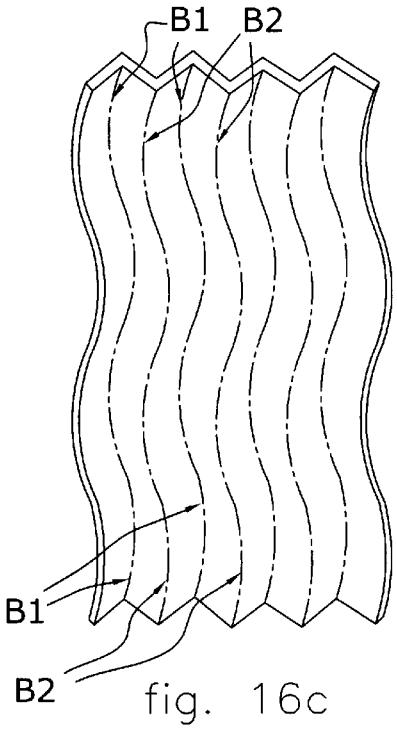
Figure 16D:
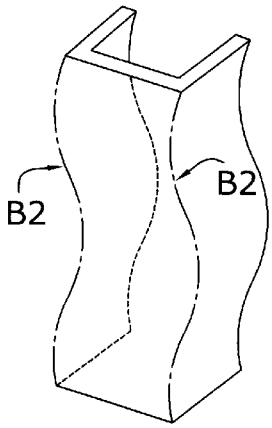
Figure 16E:
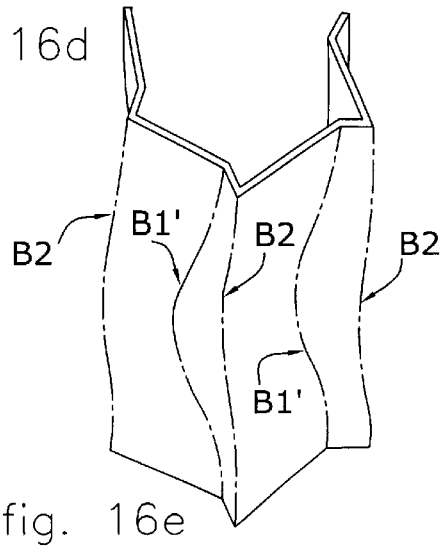

In the first type of configuration shown in FIG. 16*a*, the curved bending lines A1 and A2 are parallel or aligned in the same general direction. This configuration of bending lines can lead to a bent surface as shown in FIG. 16*b* or 16*d* where the 2-dimensional bending lines A1 and A2 transform to 3-dimensional bent lines B1 and B2 respectively. In FIG. 16*b*, the surface is bent in a zig-zag manner with alternating concave and convex angles around respective bent lines B1 and B2. This easily leads to corrugated surfaces like the one shown in FIG. 16*c*. In FIG. 16*d*, the surface is bent at convex angles only around bent lines B2. In this type of bending, the metal deforms in the bending process tehreby restricting it to small curvatures and thinner or more malleable metals. In FIG. 16*e*, two different types of bent lines B1 and B2 are used to make a curved column-type structure with alternating concave and convex bends. The latter can also be visualized as a vault-type structure when oriented horizontally, or extended to a closed cylindrical or conical form.

Figure 17A:
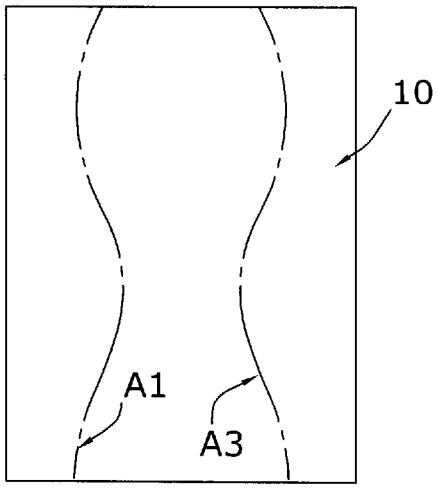
FIGS. 17*a*–*c* show a configuration of reversed doubly-curved bending lines and examples of sheet metal structures obtained after bending.
Figure 17B:
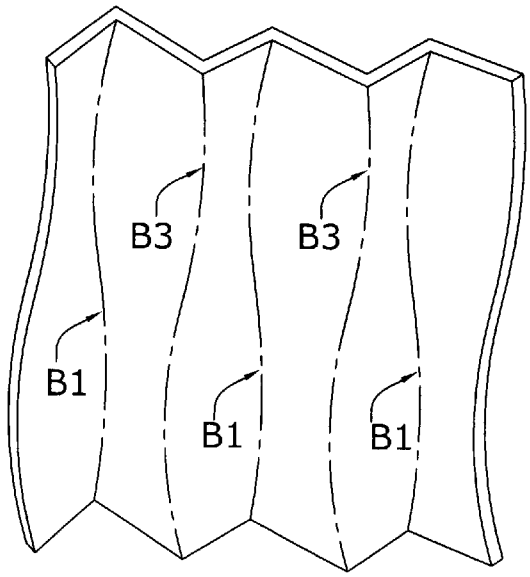
Figure 17C:
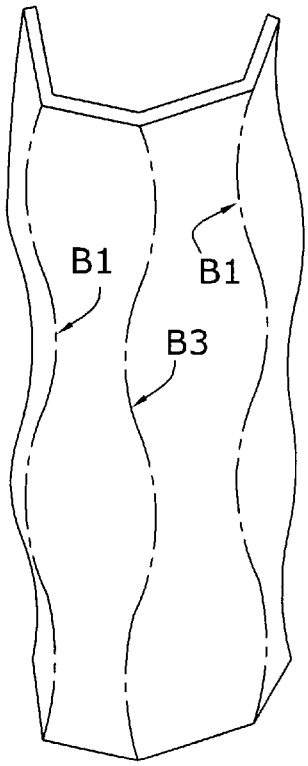

In the second type of configuration shown in FIG. 17*a*, the curved bending lines A1 and A3 are also aligned in the same direction but are reversed with respect to one another. It can be bent with alternating concave and convex bends around bent lines B1 and B3 to make a corrugated structure shown in FIG. 17*b*. This type of bending is similar to the one in FIG. 16*d* in that it deforms the sheet metal thereby restricting it to gentler curves and thinner or softer metals. The structure in FIG. 17*c* is obtained when a set of alternating bending lines B1 and B3 are bent at convex angles only. This structure can be visualized as a vault when turned horizontally or can be extended to an enclosed cylindrical or conical form.

Figure 18A:
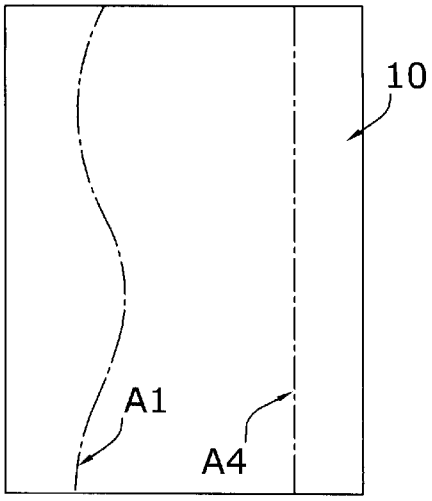
FIGS. 18*a* and 18*b* show a configuration of a doubly-curved bending line combined with a straight bending line and an example of sheet metal structure after bending.
Figure 18B:
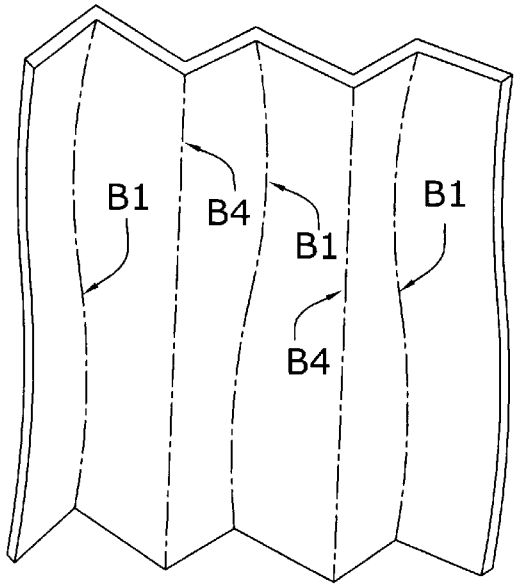

A third type of configuration of bending lines is shown in FIG. 18*a* where a curved bending line A1 is combined with a straight bending line A4. The resulting structure after bending is of the type shown in FIG. 18*b* where the concave curved bent line B1 and convex straight bent line B4 alternate to make a corrugated sheet metal structure. This structure is similar to those in FIGS. 16*d* and 17*b* where the sheet metal deforms tehreby restricting it to easily deformable or thinner metals.

Figure 19A:
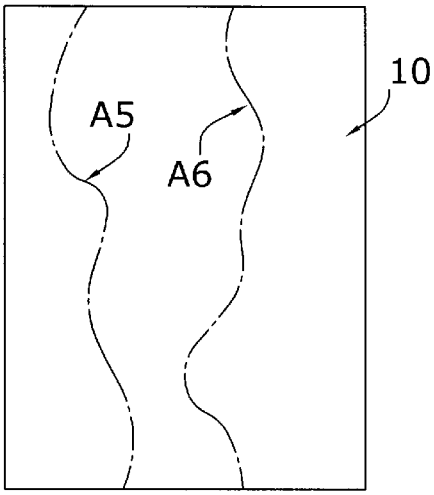
FIGS. 19*a* and 19*b* show a configuration of irregular multiply-curved curved bending lines and a derivative sheet metal structure.
Figure 19B:
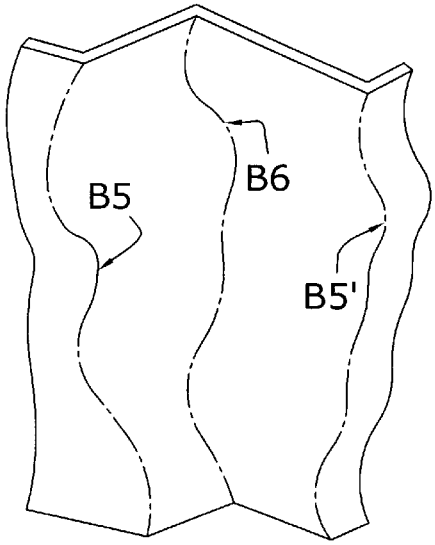

A fourth type of configuration of bending lines is shown in FIG. 19*a* where an irregular curved bending line A5 is combined with another irregular curved bending line A6. After bending, the resulting structure is of the type shown in FIG. 19*b* where the irregular convex bent lines B5 and B5 alternate with a concave bent line B6. Depending on the geometry of the curves A5 and A6, the surface of the metal may or may not deform.

Figure 20A:
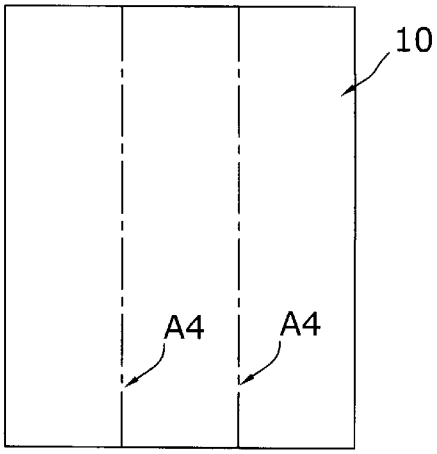
FIGS. 20*a*–*d* show a configuration of parallel straight bending lines and three different sheet metal structures having straight bends.
Figure 20B:
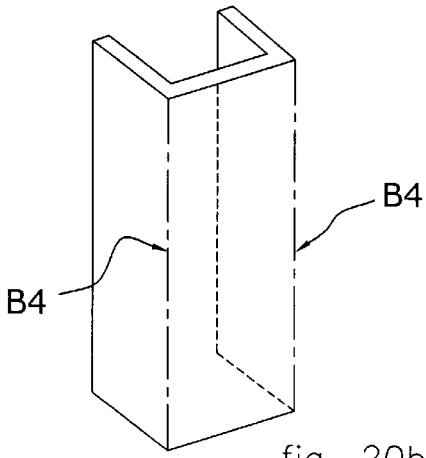
Figure 20C:
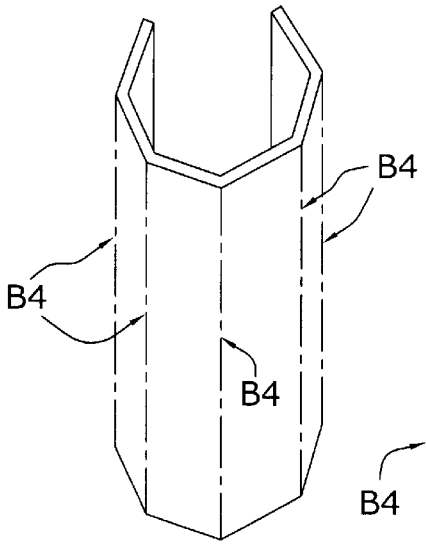
Figure 20D:
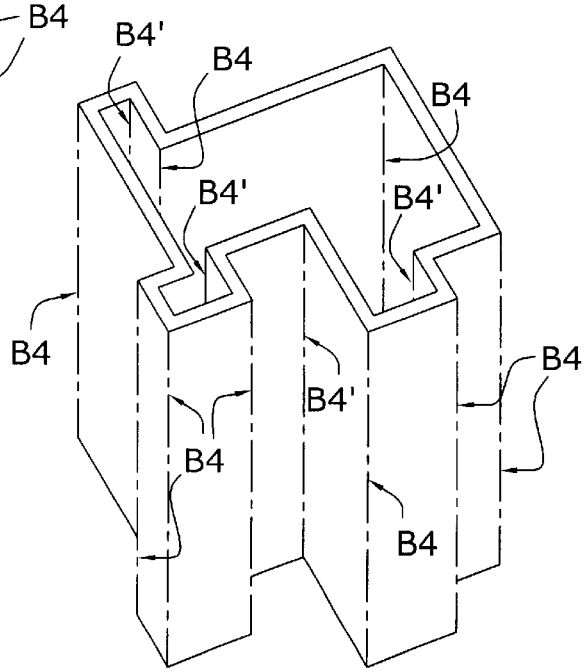

A fifth type of configuration of bending lines is shown in FIG. 20*a* where parallel straight bending lines A4 are arranged at equal or unequal distances. After bending, the resulting 3-dimensional structures could be composed of only convex bends B4 as in FIGS. 20*b* and 20*c*. These structures are potions of cylindrical surfaces. Alternatively, convex bends B4 could be combined with concave bends B4' to yield a structure of the type shown in FIG. 20*d*. The angles of bends need not be rectangular as shown in this particular example.

Figure 21A:
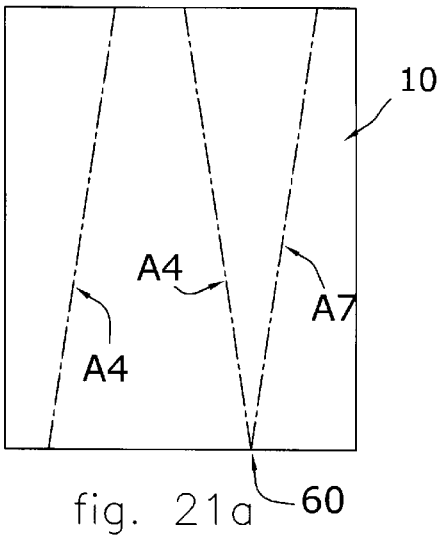
FIGS. 21*a*–*d* show a configuration of non-parallel straight bending lines and three different sheet metal structures having straight tapered bends.
Figure 21B:
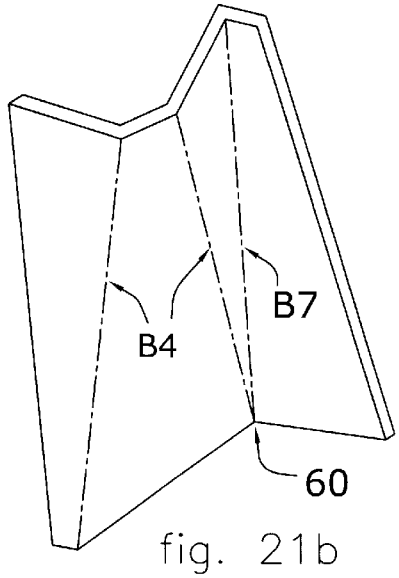
Figure 21C:
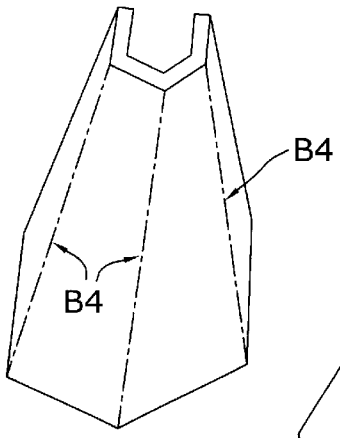
Figure 21D:
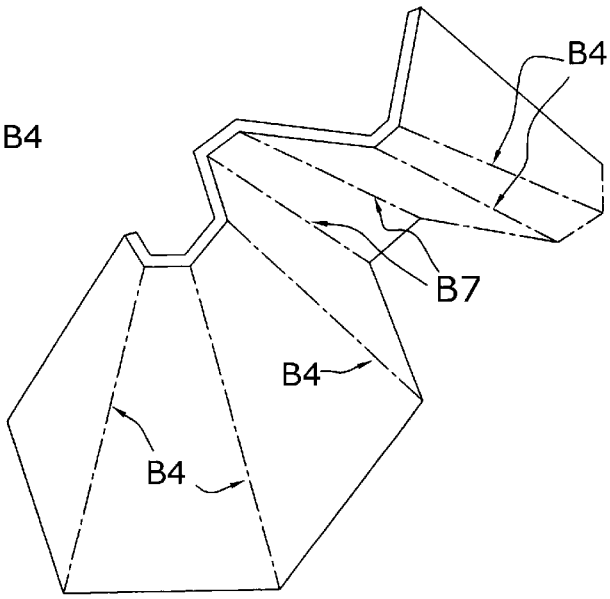
Figure 22A:
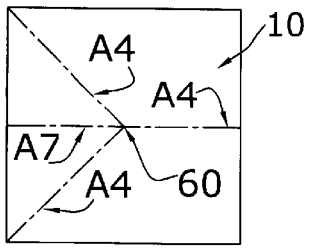
FIGS. 22*a*–*h* show a configuration of 4, 5 and 6 straight bending lines meeting at a vertex that yield different combinations of convex and concave bends after bending the sheet metal.
Figure 22B:
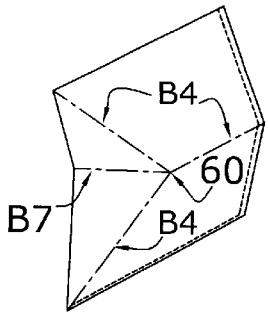
Figure 22C:
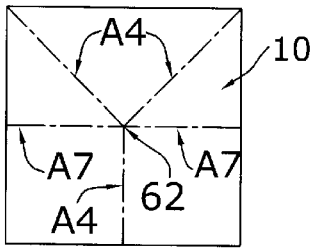
Figure 22D:
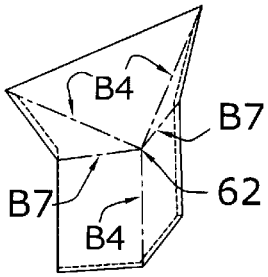
Figure 22E:
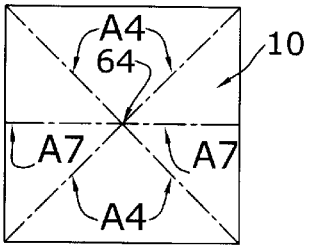
Figure 22F:
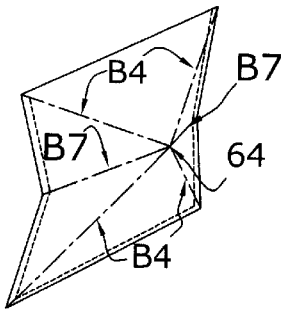
Figure 22G:
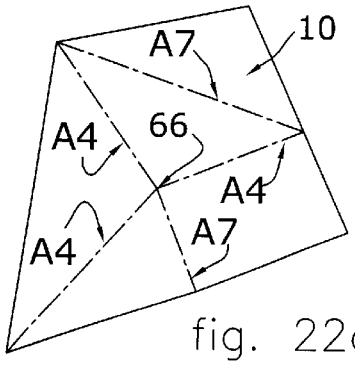
Figure 22H:
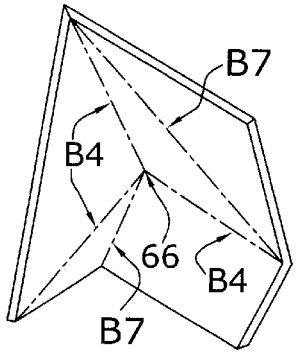

A sixth type of configuration of bending lines is shown in FIG. 21*a* where non-parallel bending lines A4 and A7 are used. After bending structures having combinations of convex bends B4 and concave bends B7 could be obtained as shown in FIGS. 21*b* and 21*d*. Or, pyramidal and tapered structures having only convex bends B4 as shown in FIG. 21*c* could be obtained. In either instances, the structures could be regular or irregular.

A seventh type of configuration of bending lines is shown in FIGS. 22 where several straight bending lines meet at a vertex. FIG. 22*a* shows 3 bending lines A4 and 1 line A7 meeting at vertex 60. After bending, this makes the folded surface in FIG. 22*b* where 3 convex bends B4 and 1 concave bend B7 meet at 60. Similarly, FIGS. 22*c* and 22*d* show 3 convex bends B4 corresponding to lines A4, and 2 concave bends B7 corresponding to lines A7, meeting at vertex 62; and FIGS. 22*e* and 22*f* show 4 convex bends B4 corresponding to A4, and 2 concave bends B7 corresponding to A7 meeting at 64. FIGS. 22*g* and 22*h* show an irregular versions of FIGS. 22*a* and 22*b* with 3 convex bends B4 and 1 concave bend B7 meeting at vertex 66. Other configurations with more lines meeting per vertex are possible.

Figure 23A:
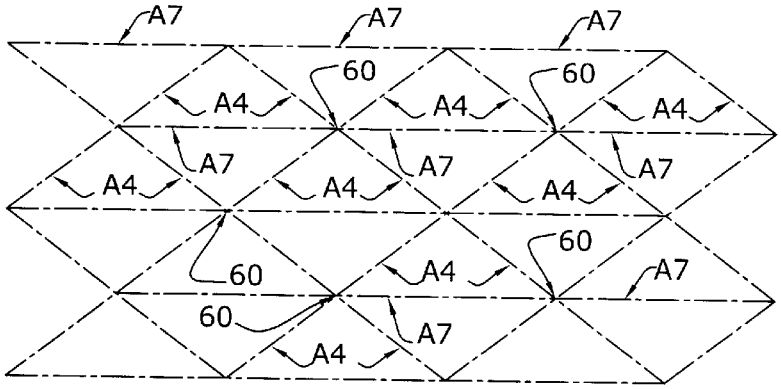
FIGS. 23*a*–*c* show three different periodic patterns of bending lines that yield folded sheet metal structures with different combinations of convex and concave bends.
Figure 23B:
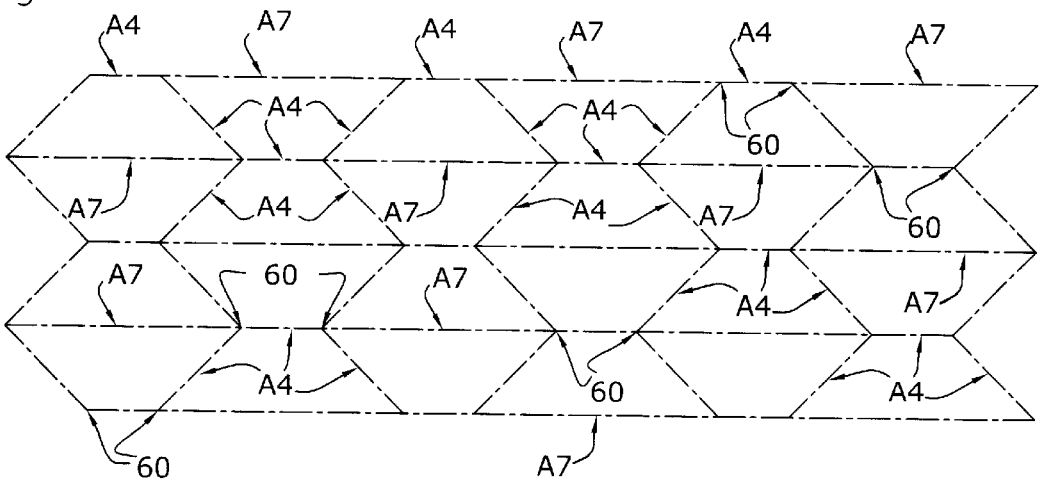
Figure 23C:
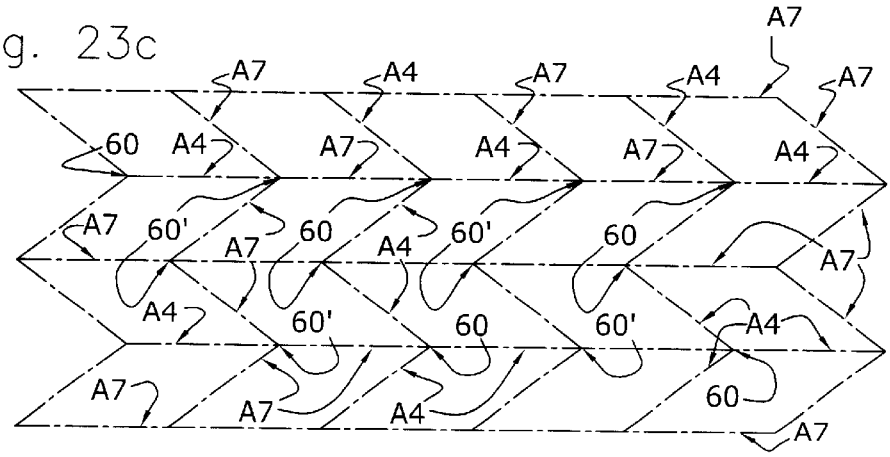

An eight type of configuration of bending lines is obtained by the tiling of different vertex conditions of bending lines. The vertex conditions in FIGS. 22*a*, 22*c* and 22*e*, and other related vertex conditions having a combination of convex and concave bends at a vertex, can be tiled to produce configurations (or tessellations) of bending lines that lead to many known and new folded surfaces after bending. Three known examples of such tessellations are shown in FIG. 23. FIG. 23*a* shows a triangular tessellation of bending lines comprising four bending lines A4 and two bending lines A7 meeting at vertices 60. After bending, lines A4 make convex bends while A7 make concave bends. The derivative structure is known and is a portion of a cylindrical folded surface or a complete cylinder having polygonal cross-sections. FIG. 23*b* comprises three bending lines A4 and one bending line A7 meeting at vertices 60. This bends similarly to FIG. 23*a* and yields a cylindrical folded surface composed of flat trapezoids. FIG. 23*c* comprises alternating columns of zig-zag bending lines A4 and A7 where lines A4 join vertices 60 and lines A7 join vertices 60'. The horizontal bending lines joining 60 and 60' alternate between A4 and A7 along both horizontal and vertical directions. After bending, A4 produces convex bends and A7 concave bends. The folded surface correspond to the curved corrugated surface in FIG. 16*c*.

Figure 24:
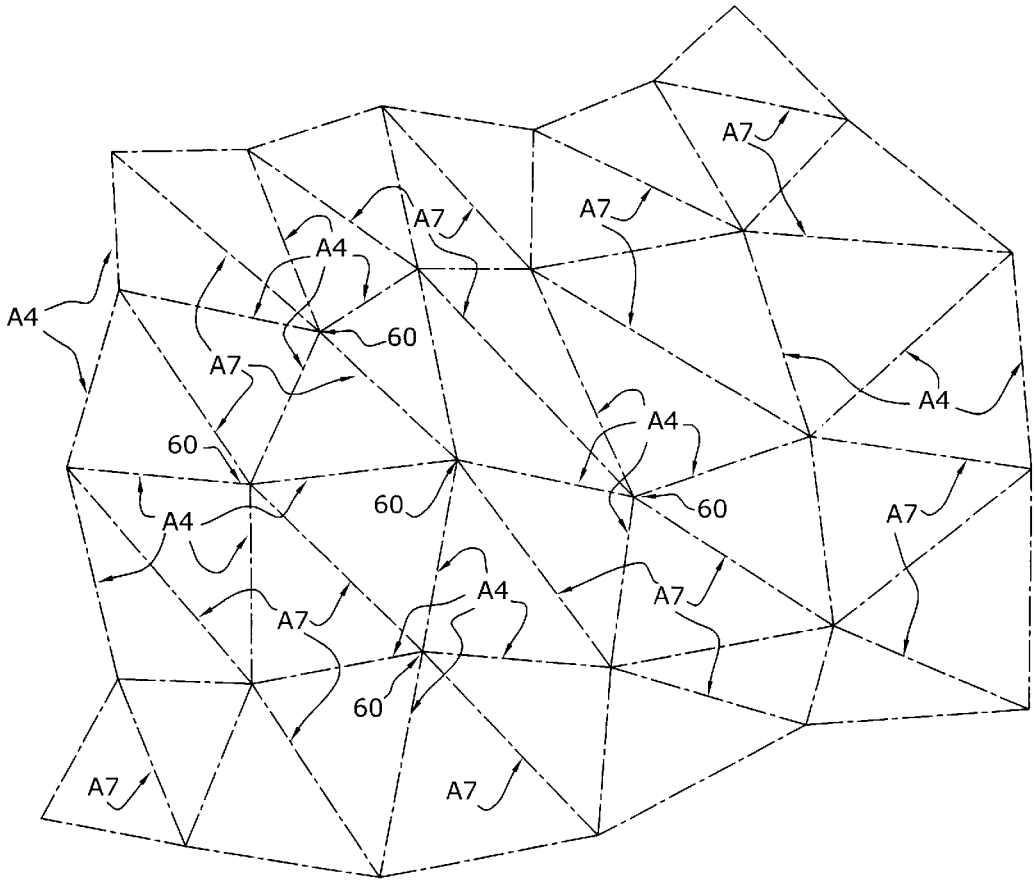
FIG. 24 shows a pattern of bending lines that folds into an irregular sheet metal structure.

A large number of folded surfaces and their corresponding tiling patterns are known in the literature, all of which could be constructed in sheet metal based on the invention. The tessellation of bending lines could be regular or irregular, repetitive or non-repetitive, flat or curved. One example of an irregular tessellation of bending lines is shown in FIG. 24. It is an irregular triangular tessellation, similar to FIG. 23*a*, and has four lines A4 and two lines A7 meeting at vertices 60. The pattern folds into a portion of an irregular cylindrical structure. Similarly, known and new folded surfaces composed of flat or curved faces and having other types of overall curvature, e.g. double-curved like a dome or a saddle, can be fabricated in sheet metal using the invention.

Figure 25A:
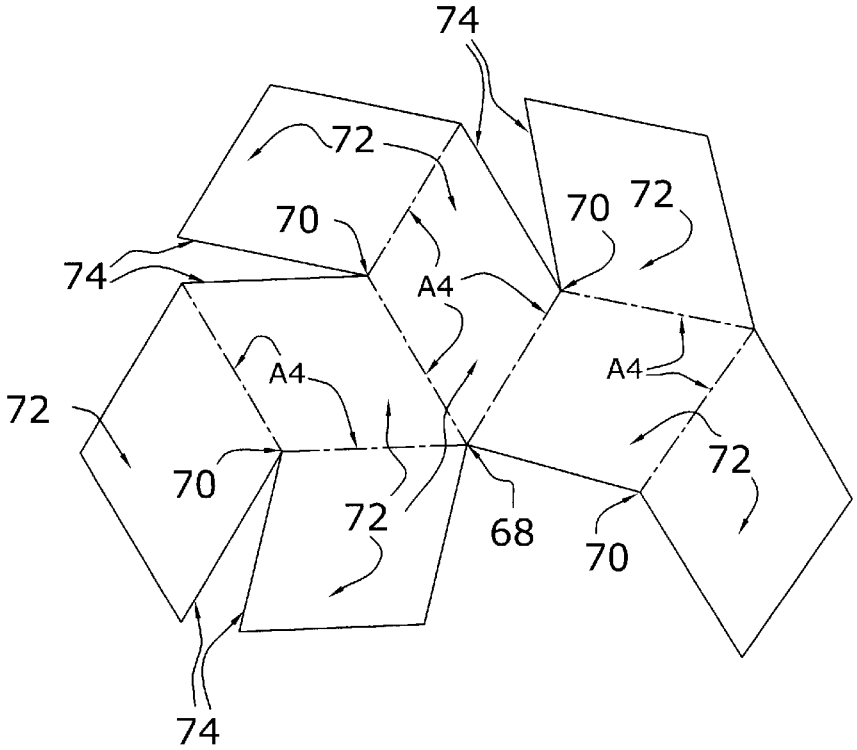
FIGS. 25*a* and 25*b* show a sheet metal pattern with straight bends that folds into a portion of a convex polyhedron.
Figure 25B:
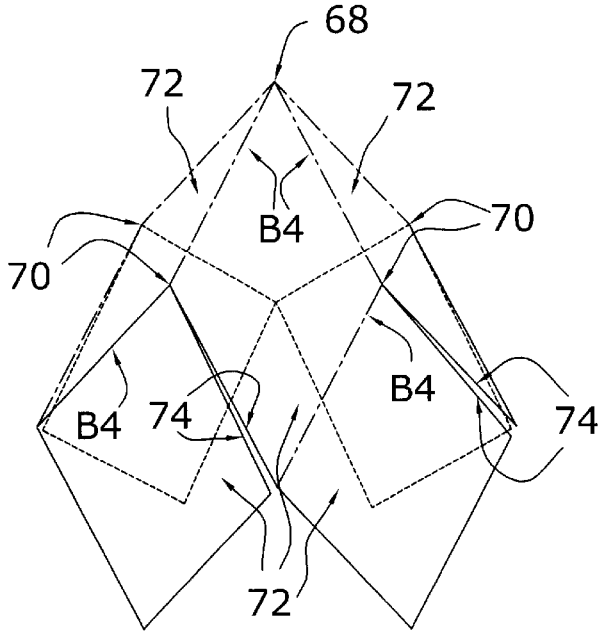

FIGS. 25*a* and 25*b* show a variation of the configurations in FIGS. 22*a–h*. FIG. 25*a* shows 4-sided polygons 72 which meet at bending lines A4 and vertices 68 and 70. It has outer edges 74 which are joined after bending. FIG. 25*b* shows a portion of a folded polyhedron, a structure with flat parallelogram faces, after bending. Other convex and concave polyhedra can be similarly constructed by cutting out their nets and folding along bending lines which define some of the hedges of the polyhedron. Any polyhedron having three or more faces meeting at a vertex, and having more than three faces can be constructed in sheet metal using bending techniques disclosed here. In addition, the faces of the polyhedron could be flat as shown, or curved.

FIGS. 26*a–e* show one example of folding of sheet metal into an origami figure. FIG. 26*a* shows a pattern with various lines of bending for folding the sheet metal into a hat. In this design, points and lines are symmetrically arranged on the left and right in pairs. Pairs of diagonal bending lines 90 and 92 and a pair of horizontal bending lines 88 meet at the vertex 76. These pairs of lines meet the outer edges of the sheet metal at corresponding vertices 78, 80 and 82, creating segments 94 and 96 on the outer edges. Additional horizontal bending lines 98 and 100 join the vertices 78 and 80, respectively. The outermost pairs of corners 84 and 86 of the sheet metal define the outermost edges 102 and 104, respectively.

The sequence of folding is illustrated in FIGS. 26*b–d*. In FIG. 26*a*, the sheet metal is halved around line 88 so that vertices 86 overlay 84. In FIG. 26*c*, the vertices 82 are folded over around diagonal lines 90 as shown. In FIG. 26*d*, the outer edges 104 (and 102, not visible in the drawing) are folded over around lines 100 (and 98, for the back faces). Finally, folded edges 100 and 98 are pulled apart to make a functional hat.

FIG. 26*e* shows a detail of the design of bending lines around the vertex 26. The bending is based on the offset stitching method so that the two rows of stitch lines are represented by the single bending line in FIG. 26*a*. For example, bending line 92 is composed of rows of cuts 92*a* and 92*b*, line 90 is composed of rows 90*a* and 90*b*. Note that the rows 90*a* and 90*b* have a large spacing between them than the space between 92*a* and 92*b*. This is due to the fact that bending line 90 (see FIG. 26*c*) is folded over bending line 92 (see FIG. 26*b*) which is folded first. It thus needs to fold over two sheets of metal.

Other origami and related figures can be similarly bent from single sheet metal sheets using any embodiment of the invention. Other known and new origami paper-folds can be realized in sheet metal by constructing them in folded parts and joining the parts together. In many instances, only approximations of paper-folds are possible due to the thickness and stiffness of sheet metal.

While the invention has been described and illustrated with reference to certain preferred embodiments thereof, those skilled in the art will appreciate that various changes, modifications and substitutions can be made therein without departing from the spirit and scope of the invention. It is intended, therefore, that the invention be limited only by the scope of the claims which follow and that such claims be interpreted as broadly as is reasonable.

What is claimed is:

1. A method for bending two opposing sections of sheet metal of thickness T about an interposed bending line to form a 3-dimensional folded structure, said method comprising the steps of:

forming a plurality of elongated slots of length a and width b within said metal along said bending line, said elongated slots having at least one edge of major length that is generally parallel to said bending line, said slots being separated by a distance c along said bending line, said slots being formed by a cutting device of width k; and bending said two opposing sections of metal sheet about said bending line, said plurality of slots encouraging said bending to occur along said bending line, wherein a is not less than c but not greater than 30 times c, b is not less than k but not greater than 2 times T, c is not less than T/2 but not greater 3 times T, and wherein said bending line is selected from a group comprising the following:

a straight line, a line curved in one direction, a line curved in two directions and having at least one S-shaped line segment, an irregular curved line, and a combination of straight and curved lines.

2. The method according to claim 1, wherein the forming step includes cutting entirely through said metal.

3. The method according to claim 1, wherein said cutting device is a laser cutter and where said width k equals the width of the laser beam.

4. The method according to claim 1, wherein said cutting device is a water jet cutter and where said width k equals the width of the water jet.

5. A method of bending two opposing sections of sheet metal of thickness T about an interposed bending line to form a 3-dimensional folded structure, said method comprising the steps of:

forming two rows of elongated slots within said metal, each said row comprising a plurality of said slots separated by a distance 'e' along said bending line, each said slot having a length 'f' and width 'i', and comprising an inner side wall located towards said bending line and an outer side wall located away from said bending line, each said slot is generally parallel to and spaced from said bending line such that the distance between two opposing said inner side wall equals j, said slots within one said row are staggered with respect to said slots within second said row by an offset distance g from either end of said slots, said slots including at least one edge of major length which is generally parallel to said bending line, said slots being formed by a cutting device of width k; and bending said two opposing sections of metal sheet about said bending line, said plurality of slots encouraging said bending to occur along said bending line, wherein f is greater than 4 times T, i is not less than .k, e equals f/2, j is not less than T, g is not less than T and not greater than 4 times T, and wherein said bending line is selected from a group comprising the following:

a straight line, a line curved in one direction, a line curved in two directions and having at least one S-shaped line segment, an irregular curved line, and a combination of straight and curved lines.

6. The method according to claim 5, wherein said cutting device is a laser cutter and where said width k equals the width of the laser beam.

7. The method according to claim 5, wherein said cutting device is a water jet cutter and where said width k equals the width of the water jet.

8. A method for bending a plurality of opposing sections of sheet metal of thickness T about a corresponding plurality of interposed bending lines to form a 3-dimensional folded structure, said method comprising the steps of:

forming a plurality of elongated slots of length a and width b within said metal along said bending line, said elongated slots having at least one edge of major length that is generally parallel to said bending line, said slots being separated by a distance c along said bending line, said slots being formed by a cutting device of width 'k'; and bending said two opposing sections of metal sheet about said bending line, said plurality of slots encouraging said bending to occur along said bending line, wherein a is not less than c but not greater than 30 times c, b is not less than k but not greater than 2 times T, c is not less than T/2 but not greater 3 times T, wherein said bending line is selected from a group comprising the following:

a straight line, a line curved in one direction, a line curved in two directions and having at least one S-shaped line segment, an irregular curved line, and a combination of straight and curved lines, and wherein said plurality of said bending lines is selected from a group comprising the following:

a configuration of parallel spaced lines, a configuration of non-parallel spaced lines, a configuration of lines that meet at one vertex, a configuration of lines that meet at a plurality of vertices that define a tiling pattern, a configuration of lines that meet at a plurality of vertices that fold into a polyhedron, and a configuration of lines that fold into an origami figure.

9. The method according to claim 8, wherein said cutting device is a laser cutter and where width k equals the width of the laser beam.

10. The method according to claim 8, wherein said cutting device is a water jet cutter and where said width k equals the width of the water jet.

11. The method according to claim 8, wherein angles between two said opposing sections of said sheet metal are convex.

12. The method according to claim 8, wherein angles between two said opposing sections of said sheet metal are a combination of convex and concave angles.

13. A method for bending a plurality of opposing sections of sheet metal of thickness T about a corresponding plurality of interposed bending line to form a 3-dimensional folded structure, said method comprising the steps of:

forming two rows of elongated slots within said metal, each said row comprising a plurality of said slots separated by a distance e along said bending line, each said slot having a length f and width i, and comprising an inner side wall located towards said bending line an outer side wall located away from said bending line, each said slot is generally parallel to and spaced from said bending line such that the distance between two opposing said inner side wall equals j, said slots within one said row are staggered with respect to said slots within second said row by an offset distance g from either side of said slots, said slots including at least one edge of major length which is generally parallel to said bending line, said slots being formed by a cutting device of width k; and bending said two opposing sections of metal sheet about said bending line, said plurality of slots encouraging said bending to occur along said bending line, wherein f is greater than 4 times T, i is not less than k, e equals f/2, j is not less than T, g is not less than T and not greater than 4 times T, and wherein said bending line is selected from a group comprising the following:

a straight line, a line curved in one direction, a line curved in two directions and having at least one S-shaped line segment, an irregular curved line, and a combination of straight and curved lines, wherein said plurality of said bending lines is selected from a group comprising the following:

a configuration of parallel spaced lines, a configuration of non-parallel spaced lines, a configuration of lines that meet at one vertex, a configuration of lines that meet at a plurality of vertices that define a tiling pattern, a configuration of lines that meet at a plurality of vertices that fold into a polyhedron, and a configuration of lines that fold into an origami figure.

14. The method according to claim 13, wherein said cutting device is a laser cutter and where said width k equals the width of the laser beam.

15. The method according to claim 13, wherein said cutting device is a water jet cutter and where said width k equals the width of the water jet.

16. The method according to claim 13, wherein angles between two said opposing sections of said sheet metal are convex.

17. The method according to claim 13, wherein angles between two said opposing sections of said sheet metal are a combination of convex and concave angles.

18. A method for bending two opposing sections of sheet metal of thickness T about an interposed bending line to form a 3-dimensional folded structure, said method comprising the steps of::

forming a continuous thinned region within said metal along said bending line, said thinned region formed as a recess of predetermined sectional shape comprising two edges separated by predetermined width w along a surface of said sheet metal, two side walls of depth t across the thickness of said sheet, and a floor region, and said recess having at least one said edge that is generally parallel to said bending line, said recess being formed by a cutting device of width k; and bending said two opposing sections of metal sheet about said bending line, said thinned region encouraging said bending to occur along said bending line, wherein w is not less than k t is not less that T/4 and not greater than 9/10ths of T, and wherein said bending line is selected from a group comprising the following:

a straight line, a line curved in one direction, a line curved in two directions and having at least one S-shaped line segment, an irregular curved line, and a combination of straight and curved lines.

19. The method according to claim 18, wherein said side walls of said recess are parallel.

20. The method according to claim 18, wherein said side walls of said recess have a divergent angle.

21. The method according to claim 18, wherein said side walls of said recess have a stepped section.

22. The method according to claim 18, wherein said recess has a generally V-shaped section.

23. The method according to claim 18, wherein said recess has a generally rectangular section.

24. The method according to claim 18, wherein said floor plane of said recess is curved.

25. The method according to claim 18, wherein said cutting device is a water jet cutter and where k is the width of the water jet.

26. A method for bending a plurality of opposing sections of sheet metal of thickness T about a corresponding plurality of interposed bending lines to form a 3-dimensional folded structure, said method comprising the steps of:

forming plurality of continuous thinned regions within said metal along said bending lines, said thinned regions formed as a recess of predetermined sectional shape comprising two edges separated by a predetermined width w along a surface of said sheet metal, two side walls of depth t across the thickness of said sheet, and a floor region, and said recess having at least one said edge that is generally parallel to said bending line, said recess is formed by a cutting device of width k; and bending said two opposing sections of metal sheet about said bending line, said thinned region encouraging said bending to occur along said bending line, wherein w is not less than k, t is not less than T/4 and not greater than 9/10ths of T, and wherein said bending line is selected from a group comprising the following:

a straight line, a line curved in one direction, a line curved in two directions and having at least one S-shaped line segment, an irregular curved line, and a combination of straight and curved lines, and wherein said plurality of said bending lines is selected from a group comprising the following:

a configuration of parallel spaced lines, a configuration of non-parallel spaced lines, a configuration of lines that meet at one vertex, a configuration of lines that meet at a plurality of vertices that define a tiling pattern, a configuration of lines that meet at a plurality of vertices that fold into a polyhedron, and a configuration of lines that fold into an origami figure.

27. The method according to claim 26, wherein said side walls of said recess are parallel.

28. The method according to claim 26, wherein said side walls of said recess have a divergent angle.

29. The method according to claim 26, wherein said side walls of said recess have a stepped section.

30. The method according to claim 26, wherein said recess has a generally V-shaped section.

31. The method according to claim 26, wherein said recess has a generally rectangular section.

32. The method according to claim 26, wherein said floor plane of said recess is curved.

33. The method according to claim 26, wherein said cutting device is a water jet cutter and where k equals the width of the water jet.

34. The method according to claim 26, wherein angles between two said opposing sections of said sheet metal are convex.

35. The method according to claim 26, wherein angles between two said opposing sections of said sheet metal are a combination of convex and concave angles.

* * * * *